US006474018B1

(12) United States Patent
Weder et al.

(10) Patent No.: US 6,474,018 B1
(45) **Date of Patent: *Nov. 5, 2002**

(54) WRAPPING MATERIAL HAVING AN EXTENSION FOR DESIGN INDICIA FOR WRAPPING FLOWER POTS AND FLORAL ARRANGEMENTS AND METHODS

(75) Inventors: Donald E. Weder, Highland; Lisa A. Straeter, Breese, both of IL (US)

(73) Assignee: Southpac Trust Int'l Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/487,421

(22) Filed: Jan. 20, 2000

Related U.S. Application Data

(63) Continuation of application No. 09/115,082, filed on Jul. 14, 1998, which is a continuation of application No. 08/479,296, filed on Jun. 7, 1995, now Pat. No. 5,784,859, which is a continuation-in-part of application No. 07/973,471, filed on Nov. 9, 1992, now Pat. No. 5,544,469, which is a continuation-in-part of application No. 07/865,563, filed on Apr. 9, 1992, now Pat. No. 5,245,814, which is a continuation of application No. 07/649,379, filed on Jan. 31, 1991, now Pat. No. 5,111,638, which is a continuation of application No. 07/249,761, filed on Sep. 26, 1988, now abandoned, said application No. 07/973,471, is a continuation-in-part of application No. 07/893,586, filed on Jun. 2, 1992, now Pat. No. 5,181,364, which is a continuation of application No. 07/707,417, filed on May 28, 1991, now abandoned, which is a continuation of application No. 07/502,358, filed on Mar. 29, 1990, now abandoned, which is a continuation-in-part of application No. 07/391,463, filed on Aug. 9, 1989, now abandoned, which is a continuation-in-part of application No. 07/249,761, filed on Sep. 26, 1988, now abandoned.

(51) Int. Cl.[7] ..... A01G 9/02
(52) U.S. Cl. ..... 47/72
(58) Field of Search ..... 47/58.1, 72, 41.01; 53/397, 410

(56) References Cited

U.S. PATENT DOCUMENTS

| | | | | |
|---|---|---|---|---|
| 787,178 | A | 4/1905 | Hopkins | |
| 931,631 | A | 8/1909 | Milhado | |
| 1,520,647 | A | 12/1924 | Hennegan | |
| 1,525,015 | A | 2/1925 | Weeks | |
| RE16,347 | E | 5/1926 | Bliss | |
| 1,689,155 | A | 10/1928 | Rittenhouse | |
| 1,821,564 | A | 10/1931 | Muller | |
| 1,868,853 | A | 7/1932 | Sievers | |
| 1,890,314 | A | 12/1932 | Crane | |
| 1,958,517 | A | 5/1934 | Low | 40/7 |
| 1,970,370 | A | 8/1934 | Foser | 47/41 |

(List continued on next page.)

FOREIGN PATENT DOCUMENTS

| | | |
|---|---|---|
| BE | 511160 | 5/1952 |
| EP | 428234 A2 | 5/1991 |
| FR | 1157678 | 6/1958 |
| GB | 5605 | 5/1885 |
| GB | 12250 | 5/1906 |
| GB | 1204647 | 9/1970 |
| GB | 1577949 | 10/1980 |
| GB | 2128083 | 4/1984 |

*Primary Examiner*—Charles T. Jordan
*Assistant Examiner*—Francis T. Palo
(74) *Attorney, Agent, or Firm*—Dunlap Cokking & Rogers

(57) ABSTRACT

A wrapping material for wrapping a floral arrangement, a flower pot, or for forming a flower pot, comprising a sheet of material, an extension of the sheet of material attached to the sheet of material, the extension having design indicia thereon, wherein the sheet of material is sized to warp about and substantially surround and encompass a floral arrangement, a flower pot, or contain a floral arrangement or potted plant. Methods of using the wrapping material to wrap a floral arrangement, a flower pot, and to form a flower pot.

6 Claims, 14 Drawing Sheets

U.S. PATENT DOCUMENTS 2,146,173 A 2/1939 Cooper ..... 217/124
2,217,454 A 10/1940 Pieffer ..... 41/34
2,303,296 A 11/1942 Avery ..... 229/53
2,340,373 A 2/1944 Gardner ..... 47/37
2,420,045 A 5/1947 Krug ..... 40/2
2,468,695 A 4/1949 Wallace et al. ..... 93/2
2,540,707 A 2/1951 Beukelman ..... 229/21
2,554,013 A 5/1951 Despres ..... 220/85
2,845,735 A 8/1958 Werner ..... 41/10
3,028,070 A 4/1962 Schnur et al. ..... 229/74
3,214,075 A 10/1965 Champlin et al. ..... 229/16
3,271,922 A 9/1966 Wallerstein et al. ..... 53/3
3,376,666 A 4/1968 Leonard ..... 47/11
3,508,372 A 4/1970 Wallerstein et al. ..... 53/3
3,556,389 A 1/1971 Gregoire ..... 229/53
3,748,781 A 7/1973 Erling ..... 47/34.11
3,821,423 A 6/1974 Jamin ..... 426/106
3,962,503 A 6/1976 Crawford ..... 428/40
3,974,915 A 8/1976 Mieuli, Jr. ..... 206/423
4,089,410 A 5/1978 Bolanowski et al. ..... 206/63.3
4,091,925 A 5/1978 Griffo et al. ..... 206/423
4,101,032 A 7/1978 Obidniak ..... 206/457
4,108,350 A 8/1978 Forbes, Jr. ..... 229/37 R
4,171,085 A 10/1979 Doty ..... 229/1.5 B
4,216,620 A 8/1980 Weder et al. ..... 47/72
4,297,811 A 11/1981 Weder ..... 47/72
4,312,523 A 1/1982 Haines ..... 283/18
4,333,267 A 6/1982 Witte ..... 47/84
4,398,983 A 8/1983 Suzuki et al. ..... 156/185
4,400,910 A 8/1983 Koudstaal et al. ..... 47/84
4,546,875 A 10/1985 Zweber ..... 206/82
4,713,839 A 12/1987 Peppiatt ..... 383/29
4,795,601 A 1/1989 Cheng ..... 264/138
4,801,014 A 1/1989 Meadows ..... 206/423
4,980,209 A 12/1990 Hill ..... 428/34.1
4,989,396 A 2/1991 Weder et al. ..... 53/397
5,007,229 A 4/1991 Weder et al. ..... 53/397
5,007,578 A 4/1991 Simone ..... 229/1.5 B
5,079,900 A 1/1992 Pinckney et al. ..... 53/413
5,105,599 A 4/1992 Weder ..... 53/399
5,106,662 A 4/1992 Khayat ..... 428/23
5,111,637 A 5/1992 Weder et al. ..... 53/397
5,111,638 A 5/1992 Weder ..... 53/397
5,145,062 A 9/1992 Crispi ..... 206/233
5,161,348 A 11/1992 Weder ..... 53/399
5,181,364 A 1/1993 Weder ..... 53/397
5,228,234 A 7/1993 de Klerk et al. ..... 47/41.01
5,235,782 A 8/1993 Landau ..... 47/72
5,245,814 A 9/1993 Weder ..... 53/397
5,293,715 A 3/1994 Kaz ..... 47/72
5,307,605 A 5/1994 Straeter ..... 53/397
5,315,785 A 5/1994 Avot et al. ..... 47/72
5,353,575 A 10/1994 Stepanek ..... 53/461
5,381,642 A 1/1995 Weder et al. ..... 53/399
5,396,992 A 3/1995 Weder ..... 206/423
5,408,803 A 4/1995 Weder et al. ..... 53/399
5,428,939 A 7/1995 Weder et al. ..... 53/397
5,443,670 A 8/1995 Landau ..... 156/191
5,467,573 A 11/1995 Weder et al. ..... 53/397
5,501,060 A 3/1996 Weder et al. ..... 53/399
5,522,202 A 6/1996 Weder et al. ..... 47/44.01
5,544,469 A * 8/1996 Weder et al. ..... 53/410
5,557,882 A 9/1996 Weder ..... 47/44.01
5,572,826 A 11/1996 Weder ..... 47/41.12
5,595,048 A 1/1997 Weder et al. ..... 53/399
5,687,502 A 11/1997 Weder ..... 47/41.01
5,816,020 A 10/1998 Weder ..... 53/397
5,976,647 A * 11/1999 Weder et al. ..... 428/34.1

* cited by examiner

WRAPPING MATERIAL HAVING AN EXTENSION FOR DESIGN INDICIA FOR WRAPPING FLOWER POTS AND FLORAL ARRANGEMENTS AND METHODS

CROSS-REFERENCE TO RELATED APPLICATIONS

This application is a continuation of U.S. Ser. No. 09/115,082, filed Jul. 14, 1998; which is a continuation of U.S. Ser. No. 08/479,296, filed Jun. 7, 1995, now U.S. Pat. No. 5,784,859, which is a continuation-in-part of U.S. Ser. No. 07/973,471, filed Nov. 9, 1992, now U.S. Pat. No. 5,544,469; which is a continuation-in-part of U.S. Ser. No. 07/865,563, filed Apr. 9, 1992, now U.S. Pat. No. 5,245,814; which is a continuation of U.S. Ser. No. 07/649,379, filed Jan. 31, 1991, now U.S. Pat. No. 5,111,638; which is a continuation of U.S. Ser. No. 07/249,761, filed Sep. 26, 1988, now abandoned; said application Ser. No. 07/973,471 is also a continuation-in-part of U.S. Ser. No. 07/893,586, filed Jun. 2, 1992, now U.S. Pat. No. 5,181,364; which is a continuation of U.S. Ser. No. 07/707,417, filed May 28, 1991, now abandoned; which is a continuation of U.S. Ser. No. 07/502,358, filed Mar. 29, 1990, now abandoned; which is a continuation-in-part of U.S. Ser. No. 07/391,463, filed Aug. 9, 1989, now abandoned; which is a continuation-in-part of U.S. Ser. No. 07/249,761, filed Sep. 26, 1988, now abandoned.

FIELD OF THE INVENTION

This invention generally relates to wrapping materials, and, more particularly, to wrapping materials for wrapping flower pots and foil arrangements, and methods of using same.

DESCRIPTION OF THE PREFERRED EMBODIMENTS

Significant characteristics of a gift of fresh flowers, a floral arrangement (with or without a container), or a potted plant is both the visual aesthetic effect provided by the plant, floral arrangement, or fresh flowers, and, additionally, the aesthetic effect provided by any wrapping material which contains such items. Therefore, the wrapping material provides an important element in the overall aesthetic experience of receiving fresh flowers, a floral arrangement, or a plant. Obviously, it would be desirable to enhance and/or extend this portion of the aesthetic enjoyment of such items.

The present invention contemplates a wrapping material for wrapping the above-defined items. The wrapping material comprises an extension which contains design indicia, which may be whimsical, representative of a holiday, a birthday, or the like. Such an extension and design indicia thereon, contained as part of the wrapping material, can be used to enhance the visual aesthetic effect of fresh flowers, a floral arrangement, or a potted plant, and may additionally be used to personalize the gift to the recipient for a special occasion, such as a birthday, an anniversary, a holiday, such as valentine's day, or other special occasion. Such a wrapping material enhances the overall aesthetic effect produced by such items.

Figure 1:
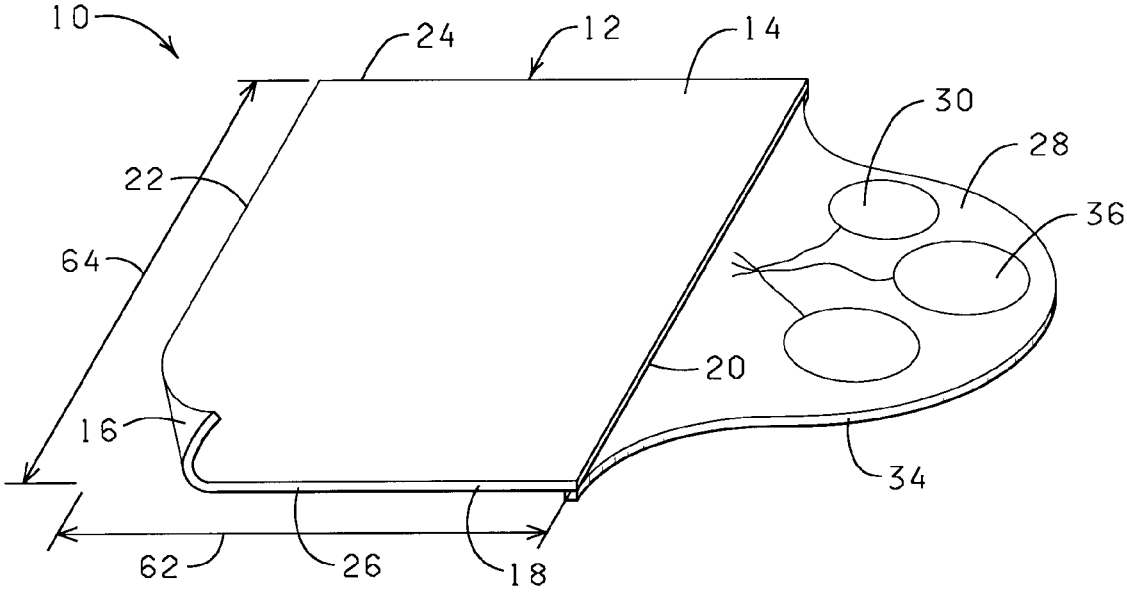
FIG. 1 is a perspective view of the wrapping material of the present invention showing the upper surface, and showing an extension having a design indicia thereon which is attached separately.
Figure 2:
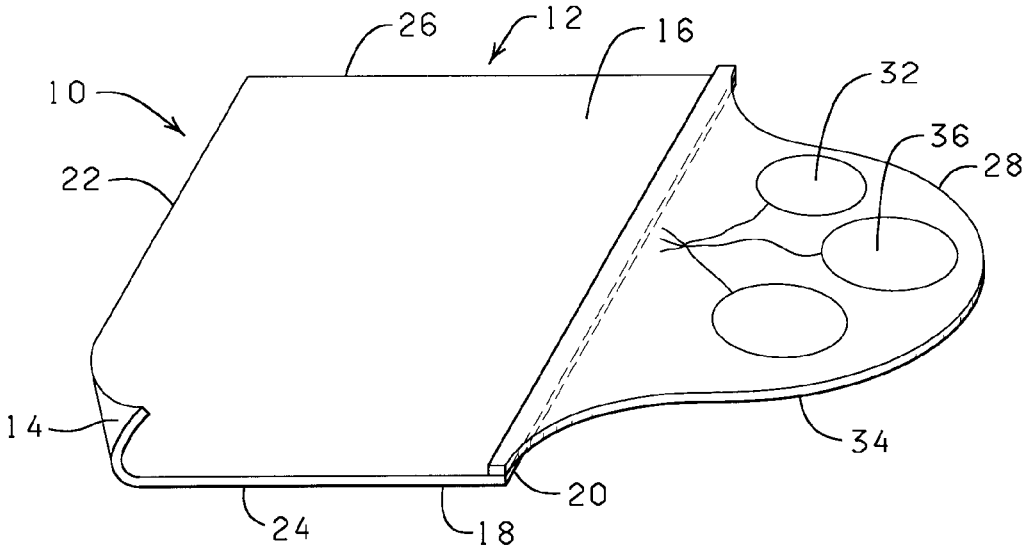
FIG. 2 is a perspective view of the wrapping material of FIG. 1, but showing the lower surface thereof.

The Embodiment of FIGS. 1–2

Referring to FIGS. 1–2, designated generally by the reference numeral 10 is a wrapping material which is constructed in accordance with the present invention. The wrapping material 10 comprises at least one sheet of material 12. The sheet of material 12 has an upper surface 14, a lower surface 16 (one edge of the sheet of material lifted for illustration purposes only), and an outer periphery 18. In the embodiment show in FIG. 1, the outer periphery 18 of the sheet of material 12 comprises a first side 20, a second side 22, a third side 24, and a fourth side 26. It will be appreciated, however, that the sheet of material 12 may comprise a variety of shapes. The sheet of material 12 also has an extension 28.

Figure 3:
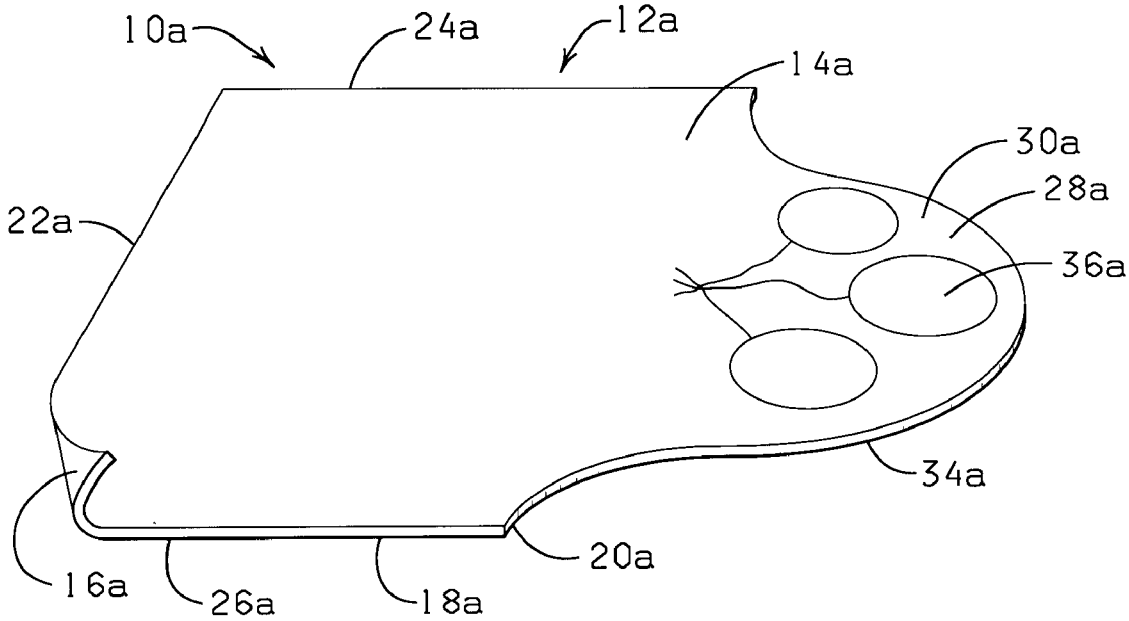
FIG. 3 is a perspective view of a modified wrapping material constructed exactly like the wrapping material of FIGS. 1–2, but showing the extension as an integral part of the wrapping material.

The extension 28 connects at or near the outer periphery 18 of the sheet of material (FIGS. 1 and 2), or, alternatively, may form a non-separate, integral part of the sheet of material 12 (FIG. 3). The extension 28 has an upper surface 30, a lower surface 32 and an outer periphery 34. Located on at least a portion of the extension 28 is a design indicia 36.

The extension 28 may also comprise one or more shape sustaining elements. "Shape sustaining elements" means wire or rods, made of metal or plastic (synthetic resinous plastic), cardboard, hollow plastic, such as straws, natural fiber, such as, but not by way of limitation, bamboo, wood, or a combination thereof, which imparts sufficient shape to permit the extension 28 to extend above a floral arrangement, flower pot, or potted plant as described in greater detail below. Such a shape sustaining element may be attached to the extension 28 and/or the sheet of material 12 via a bonding material, the element laminated between extensions 28 and/or sheets of material 12, or by any method described herein or known in the art. It will be appreciated that the extension 28 is connected to the sheet of material 12 by any method described herein, or known in the art. It will also be understood that the shape sustaining element may be utilized with any or all embodiments of the present invention shown and/or described herein.

The extension 28 and/or the sheet of material 12 may also comprise a balloon portion. The balloon portion is created by providing a second extension 28' and/or second sheet of material 12'. It will be understood that a second extension 28' and a second sheet of material 12' will have all of the characteristics and features described above for the first extension 28 and the first sheet of material 12. The first extension 28 and the second extension are aligned one on top of another and the outer peripheries 34 and 34' of the first extension 28 and the second extension 28' are connected together, except for one small area, creating a "pocket " between the first and second extensions 28 and 28'. Air, such as room air, or alternatively, a gas, such as, but not by way of limitation, helium, or a combination of room air and a gas, is introduced into the pocket created by joining the first and second extensions 28 and 28', respectively, together. The small area where the air and/or gas was introduced is then quickly sealed, and the respective first and second extensions 28 and 28' will puff outward, creating a balloon portion 29. It will be appreciated that the balloon portion 29 may be created in the first and second sheets of material 12 and 12' in the same manner as described above for the first and second extensions 28 and 28'. The pocket which forms the balloon portion may be sealed by any means shown and/or described herein, such as, but not by way of limitation, a bonding material or heat sealing, or by any means known in the art. The first or second extension 28 and 28' and/or the first or second sheet of material 12 and 12' may also be formed with a self-sealing valve or inlet port, or a valve or inlet port which is easily sealable by an operator, to permit the introduction of an air or gas into the formed pocket. It will also be understood that the balloon portion 29 may comprise one or more shape sustaining elements 29. In another alternative, the balloon portion of the extension 28 may comprise a balloon; such balloons are well known and commercially available. In yet a further alternative, a first and second extension 28 and 28', as described previously, are utilized, but the pocket is filled not with air and/or gas but with a filler substance, such as, but not by way of limitation, shredded paper, styrofoam, and the like, to give the appearance of a balloon portion. This alternative recognizes the difficulty in forming an air-tight seal to retain the air and/or gas in the pocket which forms the balloon portion.

It will be appreciated that an air-tight seal is unnecessary when the "puffiness" of the balloon portion is created by a filler substance rather than air and/or gas. It will also be appreciated that the balloon portion may be utilized with any or all embodiments of the present invention shown and/or described herein.

The sheet of material 12 is utilized to wrap a flower pot 38 (FIGS. 12–15). The flower pot 38 (FIG. 13) comprises an upper end 40, a lower end 42, and an outer surface 44. The upper end has an opening 46 that is formed in the flower pot 38, with a portion of the flower pot opening 46 intersecting the upper end 40 the flower pot 38 forming an inner surface 48. A rim 49, namely thickened "collar," surrounds the round opening 46, and extends circularly around the upper end 40 of the flower pot 38. The flower pot opening 46 is sized and shaped for receiving a floral arrangement 50 or a plant 52 having potted soil thereabout (potted plant), or combinations thereof (not shown), the floral arrangement 50 or plant 52 being retained in the flower pot opening 46 by the flower pot 38.

The term "flower pot" means any type of floral container used to hold a floral arrangement 50 or a potted plant 52. Examples of flower pots 38 used in accordance with the present invention include clay flower pots, plastic flower pots, and the like.

The sheet of material 12 is also used to wrap fresh flowers, or a floral arrangement 50. "Floral arrangement" is used herein and means fresh cut flowers, artificial flowers, other fresh and/or artificial plants or other floral materials and may include other secondary plants and/or ornamentation which add to the aesthetics of the overall floral arrangement 50. The floral arrangement 50 comprises a flower portion 54 which may comprise either a bloom or foliage portion and a stem portion 56. However, it will be appreciated that the floral arrangement 50 may consist of only a single bloom or only foliage (not shown).

"Potted plant" is used herein means any living plant which is contained within a flower pot 38 as described herein. Such a potted plant 52 has a flower end 58 (not shown) which may comprise blooms, or merely foliage, or both, and a root end 60 (not shown).

In the embodiment of FIG. 1, the sheet of material 12 is square, and the extension 28 is rounded on one portion of the outer periphery 34, and straight on the other portion of the outer periphery 34. It will be appreciated, however, that any shape or size of sheet of material 12 may be used to wrap a flower pot 38 or a floral arrangement 50 as long as it is sufficiently sized and shaped to wrap and encompass the flower pot 38 or floral arrangement 50; similarly, any shape or size of extension 28 may be utilized and attached to the sheet of material 12. For example, the sheet of material 12 and/or the extension 28 may also comprise other geometric and nongeometric shapes, i.e., rectangular, round, oval, octagonal, asymmetrical, abstract, flower-shaped, and the like. And multiple sheets of material 12 and/or extensions 28 may be used. Moreover, when multiple sheets of material 12 and/or multiple extensions 28 are used in combination, the sheets of material 12 and/or the extensions 28 need not be uniform in size or shape. Finally, it will be appreciated that the sheet of material 12 shown in all embodiments herein is substantially flat.

The sheet of material 12 may be constructed of a single sheet of material 12 or a plurality of sheets of material 12; similarly, the extension 28 may be constructed of a single extension 28 or a plurality of extensions 28. Any thickness of the sheet of material 12 and/or the extension 28 may be utilized in accordance with the present invention as long as the sheet of material 12 may be wrapped about at least a portion of a flower pot 38 or a floral arrangement 50, as described herein. The sheet of material 12 and/or the extension 28 has a thickness of less than about 1 mil to about 30 mils. Typically, the sheet of material 12 and/or the extension 28 has a thickness in a range of less than about 0.2 mils to about 10 mils. In a preferred embodiment, the sheet of material 12 and the extension 28 is constructed from one sheet of man-made organic polymer film having a thickness. in a range of from less than about 0.5 mils to about 2.5 mils. It will be appreciated that the extension 28 may comprise a different thickness than the sheet of material 12, or vice versa.

The sheet of material 12 is constructed from any suitable material that is capable of being wrapped about a flower pot 38 or floral arrangement 50. Preferably, the sheet of material 12, and the extension 28, comprises paper (untreated or treated in any manner), cellophane, foil, man-made organic polymer film, fiber (woven or nonwoven or synthetic or natural), cloth (woven or nonwoven or natural or synthetic), burlap, or any combination thereof. It will be appreciated that the sheet of material 12 may be constructed from a different material than that used to construct the extension 28.

The term "man-made organic polymer film" means a man-made resin such as a polypropylene as opposed to naturally occurring resins such as cellophane. A man-made organic polymer film is relatively strong and not as subject to tearing (substantially non-tearable), as might be the case with paper or foil. The man-made organic polymer film is a substantially linearly linked processed organic polymer film and is a synthetic linear chain organic polymer where the carbon atoms are substantially linearly linked. Such films are synthetic polymers formed or synthesized from monomers. Further, a relatively substantially linearly linked processed organic polymer film is virtually waterproof which may be desirable in many applications such as wrapping a floral arrangement.

Additionally, a relatively thin film of substantially linearly linked processed organic polymer does not substantially deteriorate in sunlight. Processed organic polymer films having carbon atoms both linearly linked and cross linked, and some cross linked polymer films, also may be suitable for use in the present invention provided such films are substantially flexible and can be made in a sheet-like format for wrapping purposes consistent with the present invention. For example, one such man-made organic polymer film is a polypropylene film.

The term "polymer," as used herein means any polymer film. For example, but not by way of limitation, one polymer film is a polypropylene film. Another example of a polymer film, but not by way of limitation, is cellophane.

The sheet of material 12 and/or the extension 28 may vary in color. Further, the sheet of material 12 and/or the extension 28 may consist of designs which are printed, etched, and/or embossed; in addition, the sheet of material 12 and/or the extension 28 may have various colorings, coatings, flocking and/or metallic finishes, or be characterized totally or partially by pearlescent, translucent, transparent, iridescent, or the like, characteristics. Each of the above-named characteristics may occur alone or in combination. Moreover, each surface of the sheet of material 12 and/or the extension 28 may vary in the combination of such characteristics.

The sheet of material 12 has a width 62 (FIG. 1) extending generally between the first side 20 and the second side 22, respectively, sufficiently sized whereby the sheet of material 12 can be wrapped about and substantially surround and encompass a flower pot 38 or a floral arrangement 50. The sheet of material 12 has a length 64 (FIG. 1) extending generally between the third side 24 and the fourth side 26, respectively, sufficiently sized whereby the sheet of material 12 extends over a substantial portion of the flower pot 38 or the floral arrangement 50 when the sheet of material 12 has been wrapped about the flower pot 38 or the floral arrangement 50 in accordance with the present invention shown and described in detail herein. In two embodiments (FIGS. 5 and 6), the extension 28 has a width 67 which permits the extension to extend substantially around a flower pot 38 or a floral arrangement 50.

Figure 5:
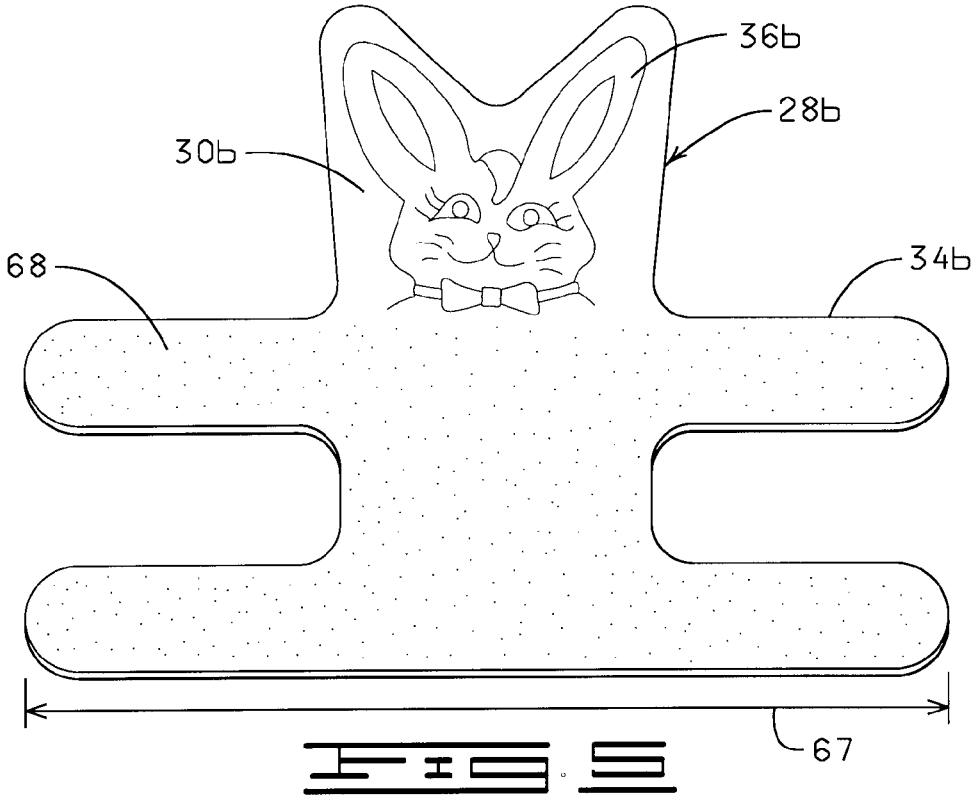
FIG. 5 is a perspective view of a modified extension constructed exactly like the extension of FIGS. 1–2, but showing the extension separated from the sheet of material, and showing the upper surface of the extension, the extension being a different configuration.
Figure 6:
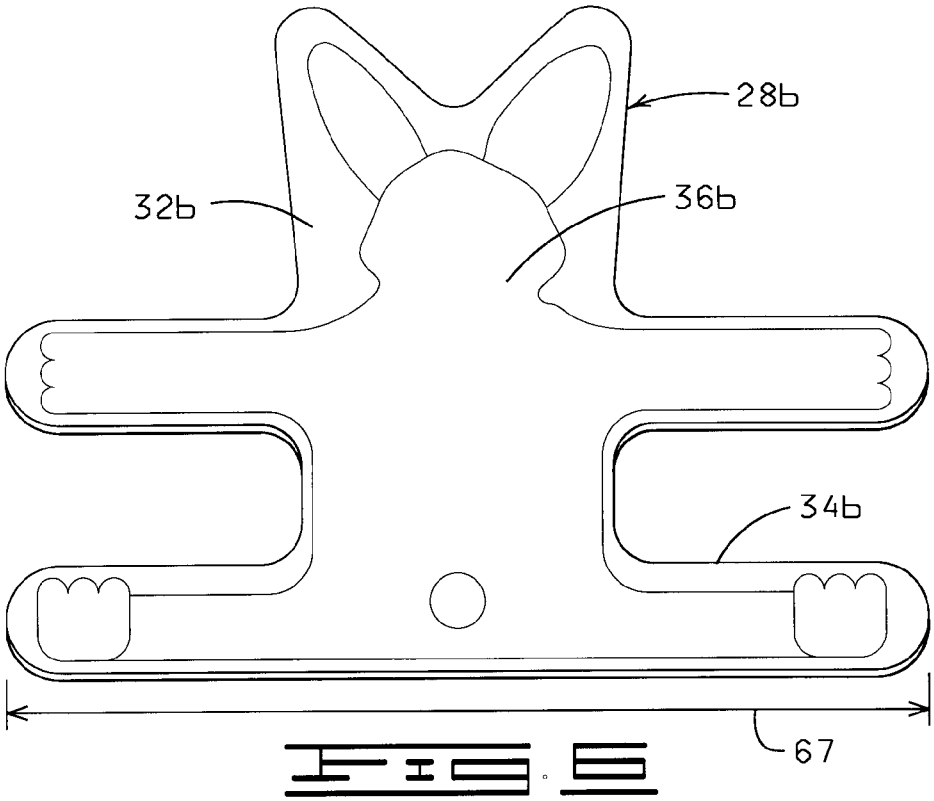
FIG. 6 is a perspective view of the extension of FIG. 5, but showing the lower surface thereof.

The extension 28 of the sheet of material 12 further comprises at least one design indicia 36. "Design indicia" as used herein includes (but is not limited to) fanciful designs such as rabbits, hearts, balloons, pumpkins, clover, eggs, chicks, tombstones, and the like. Additional examples of design indicia include flowers (such as roses, daisies, lilacs), plants (such as fruits, vegetables, clover, grasses, trees), mammals (rabbits, dogs, cats, and the like), fictional characters (such as cartoon characters), non-mammals (birds, alligators, and the like), or real characters (such as a photograph of an individual), and the like. Design indicia 36, as used herein, may also include printed information, including letters, numbers, and other symbols. Design indicia 36 may vary between the upper surface 30 and the lower surface 32 of the extension 28 (FIGS. 5 and 6).

Design indicia 36, as used herein, may also include care tag information (not shown). Care tags have traditionally been attached to stakes and disposed in the potting soil surrounding a plant, or, alternatively, connected to the plant itself. Such care tags included printed information, and, at times, various pictures of the potted plant 52, along with the recommended care of the floral arrangement 50 or potted plant 52, such as information and recommendations for watering, sunlight exposure, fertilization, cutting and the like. The care tag information, with or without a picture of the potted plant 52 or floral arrangement 50, may form at least a portion of the design indicia 36 on the extension 28. Care tags, and care tag information, are commercially available, and are well-known in the art. Finally, the design indicia 36 on the extension 28 may also include a UPC (Uniform Product Code) mark (namely, a bar code marking on the product, which may be automatically scanned by special equipment, thus permitting the price of the flower pot 38 or floral arrangement 50 to be automatically registered on a cash register, or other registering means). Such UPC marks are well known in the art, and are commercially available. Alternatively, the UPC mark may be placed on the sheet of material 12 in any location, by any means described herein or known in the art.

The design indicia 36 may be disposed upon the extension 28 and, additionally in some instances, the sheet of material 12 by use of a dye, ink, and/or pigment. Such dyes, inks, and/or pigments are known in the art and are commercially available, and may be disposed upon or incorporated in the extension 28 and/or the sheet of material 12 by any method described herein or known in the art. That is, the design indicia 36 may be painted upon the extension 28, sprayed upon the extension 28, printed upon the extension 28, or incorporated upon the extension 28 during the extrusion process. The extrusion of polymer films is well-known in the art.

When the extension 28 comprises a separate sheet of material, the extension 28 is attached to the sheet of material 12 by use of a bonding material 68. The term "bonding material" as used herein means an adhesive, preferably a pressure sensitive adhesive, a thermal sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" as used herein also means a heat sealing lacquer which may be applied to the sheet of material 12 and, in this instance, heat also must be applied to effect the sealing. The term "bonding material" as used herein means any type of material or thing which can be used to effect the bonding or connecting of the two adjacent portions of the material or sheet of material as described herein.

Further, the bonding material 68 may also comprise one or more colors derived from dye, ink, or pigment previously described herein. Bonding materials 68, as described herein, are known in the art, and commercially available.

The bonding material 68, as previously described, is preferably a pressure sensitive adhesive, or, alternatively, a is thermal-sensitive adhesive, or a cohesive. Such use of pressure sensitive adhesives is taught in U.S. Pat. No. 5,111,638, entitled, "Method for Wrapping an Object With a Material Having Pressure Sensitive Adhesive Thereon," and is hereby incorporated by reference herein. Adhesives, pressure sensitive adhesives, thermal-sensitive adhesives and cohesives are well known in the art and are commercially available.

The Embodiment of FIG. 3

Illustrated in FIG. 3 is a modified wrapping material 10*a* which is constructed exactly like the wrapping material 10 shown in FIGS. 1 and 2, and described in detail previously, except that the extension 28*a* forms an integral part of the sheet of material 12*a*.

The material 10*a* is used in the same methods of use as described below for all wrapping materials shown and described in detail herein.

Figure 4:
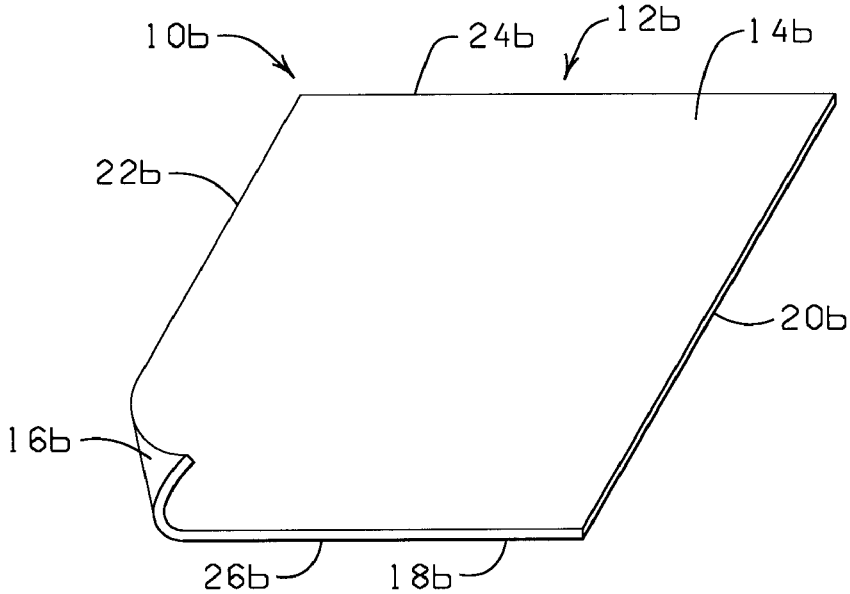
FIG. 4 is a perspective view of a modified wrapping material constructed exactly like the wrapping material of FIGS. 1–2, but showing the sheet of material with the extension detached.

The Embodiment of FIGS. 4–6

Illustrated in FIGS. 4–6 is a modified wrapping material 10*b* which is constructed exactly like the wrapping material 10 shown in FIGS. 1 and 2 and described in detail previously, except that the extension 28*b* is formed in a different abstract shape, and the extension 28*b* (FIGS. 5–6) is shown unattached to the sheet of material 12*b*, and the extension 28*b* has an extended width 67. Further, the extension 28*b* illustrates design indicia 36*b* which varies between the upper surface 30*b* and the lower surface 32*b*, and a portion of the upper surface 30*b* of the extension 28*b* has a bonding material 68 thereon.

Figure 22:
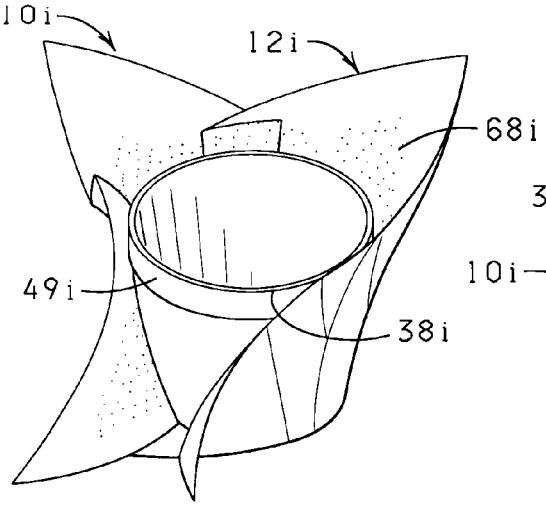
FIG. 22 is a perspective view of the wrapping material of FIG. 4, but showing a partially wrapped flower pot.
Figure 23:
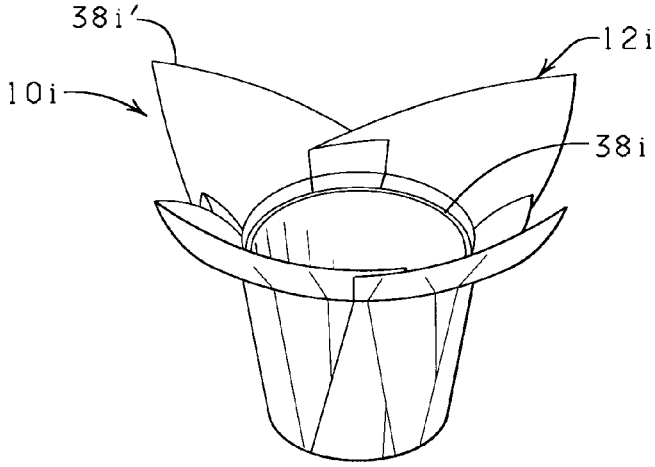
FIG. 23 is a perspective view of the wrapping material of FIG. 4, but showing a wrapped flower pot.
Figure 24:
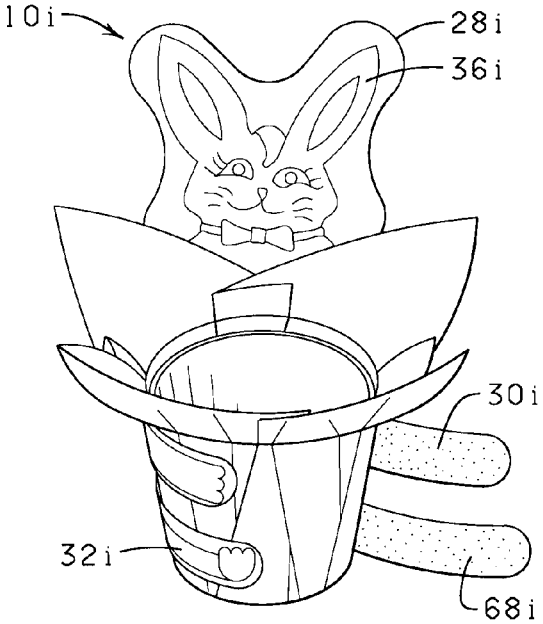
FIG. 24 is a perspective view of the wrapped flower pot of FIG. 23, but showing the extension of FIGS. 5–6 partially wrapped about the flower pot cover.
Figure 25:
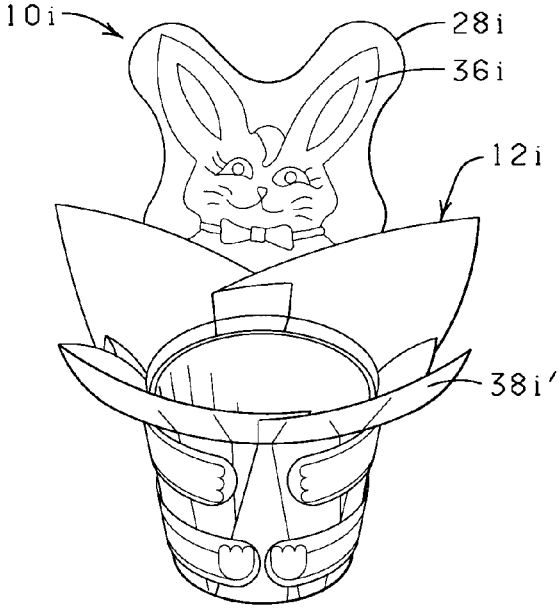
FIG. 25 is a perspective view of the wrapped flower pot of FIG. 23, but showing the extension of FIGS. 5–6 wrapped about the flower pot cover.
Figure 26:
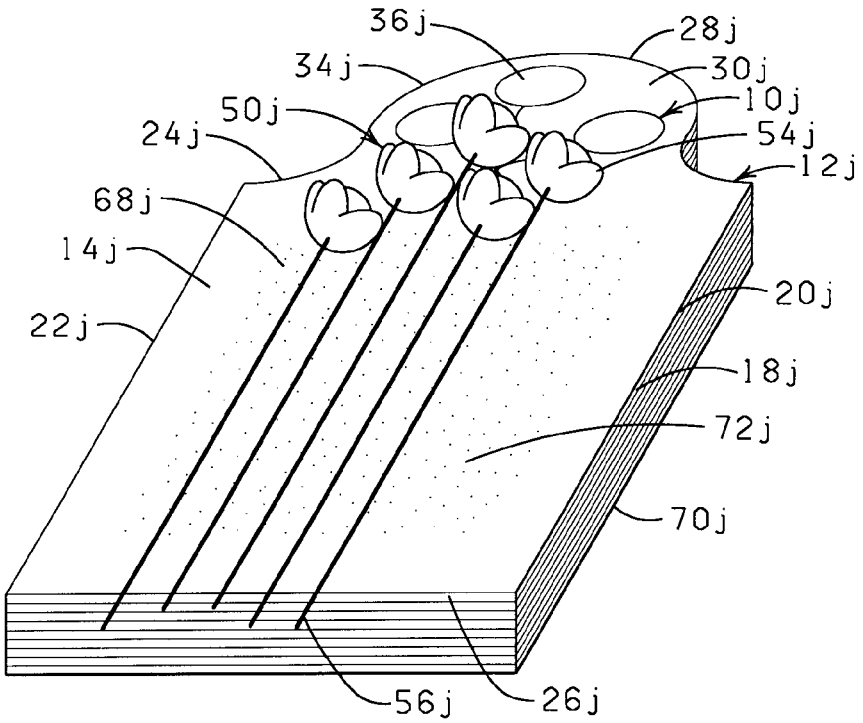
FIG. 26 is a perspective view of the wrapping material of FIG. 8, but showing a floral arrangement disposed thereon.

In this embodiment, the extension 28*b* may be used with a pre-formed flower pot cover 38*b*' (not shown) or a hand-formed flower pot cover 38*b*' (FIGS. 22–23) to secure the pot cover 38*b*' around the flower pot 38*b* (FIGS. 24–25). That is, the extension 28*b*, or a portion thereof, may extend substantially, or completely, around the pot cover 38*b*' to secure the flower pot cover 38*b*' to the flower pot 38*b*. Further, at least a portion of the extension 28*b* may extend around the pot cover 38*b*' above the level of rim 49*b* of the flower pot 38*b* (not shown). Alternatively, the extension 28*b* may extend around the pot cover 38*b*' at the same level as the rim 49*b* of the flower pot 38*b* (FIG. 25). In another alternative, the extension 28*b* may extend around the pot cover 38*b*' below the rim 49*b* of the flower pot 38*b* (FIG. 25). Finally, the extension 28*b* may extend substantially around the pot cover 38*b*' at more than 1 level of the flower pot 38*b*, that is, at multiple levels, to secure the flower pot cover 38*b*' over the flower pot 38*b* (FIG. 25). The method of use of the embodiment shown in FIGS. 4–6 will be described in detail below.

Figure 7:
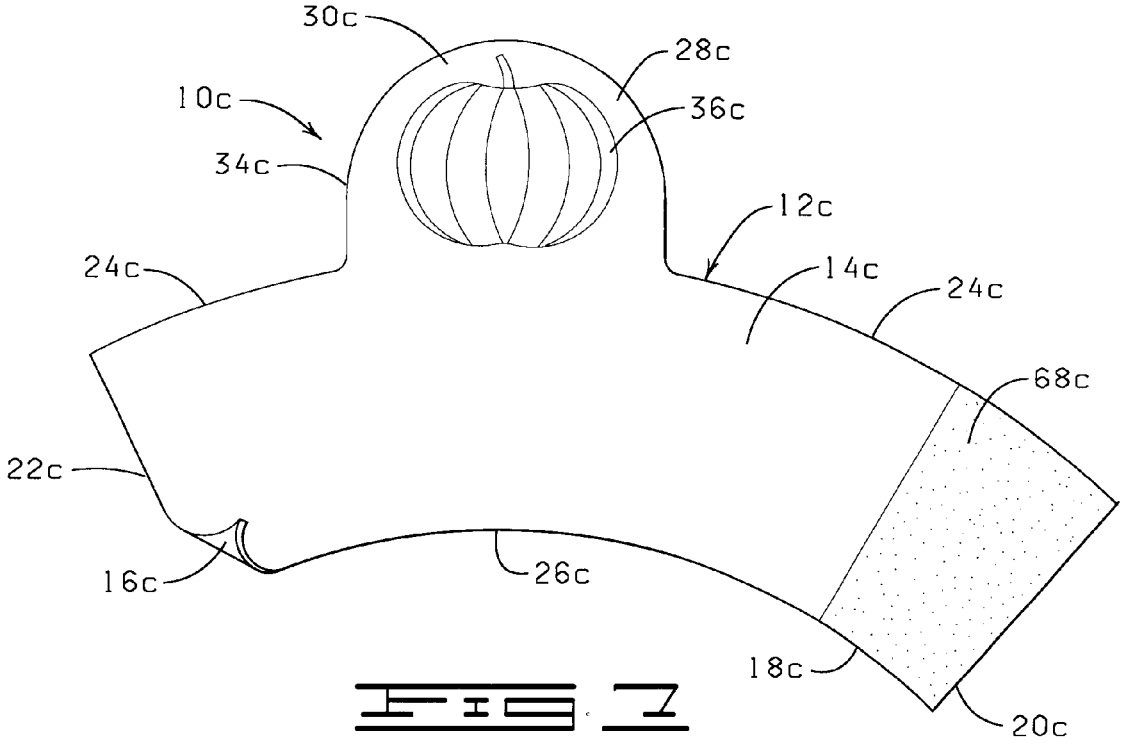
FIG. 7 is a perspective view of a modified wrapping material constructed exactly like the wrapping material of FIG. 3, but showing two arcuately curved sides of the sheet of material, and a bonding material disposed on a portion of the material.

The Embodiment of FIG. 7

Illustrated in FIG. 7 is a modified wrapping material 10*c* which is constructed exactly like the wrapping material 10 shown in FIGS. 1 and 2, and described in detail previously, except that two sides of the sheet of material 12*c*, namely, the third side 24*c* and the 4th side 26*c* are arcuately curved, and except that the extension 28*c* forms an integral part of the sheet of material 12*c*. A portion of the sheet of material 12*c* near the first side contains bonding material 68*c*.

Figure 20:
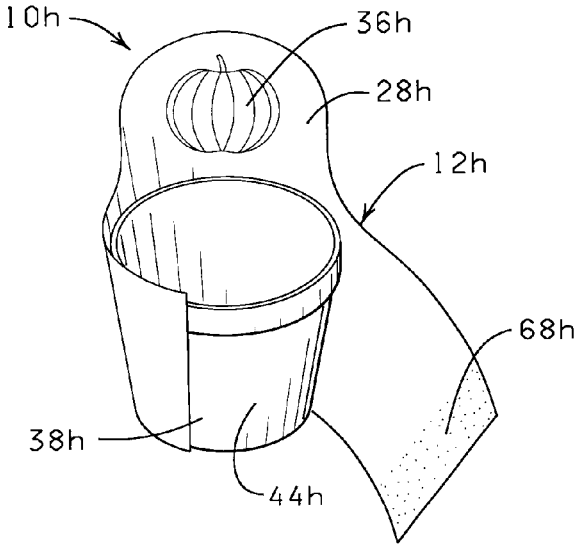
FIG. 20 is a perspective view of the wrapping material of FIG. 7, but showing a partially wrapped flower pot.
Figure 21:
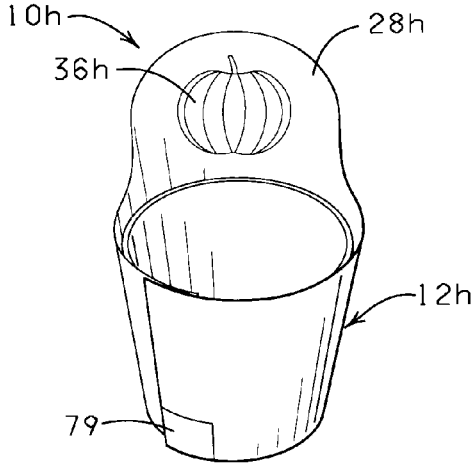
FIG. 21 is a perspective view of the wrapping material of FIG. 7, but showing a wrapped flower pot.

The sheet of material 12*c* is utilized to wrap a flower pot 38*c* (FIGS. 20–21). The method of use utilizing the sheet of material 12*c* to wrap a flower pot 38*c* will be described in detail below.

Figure 8:
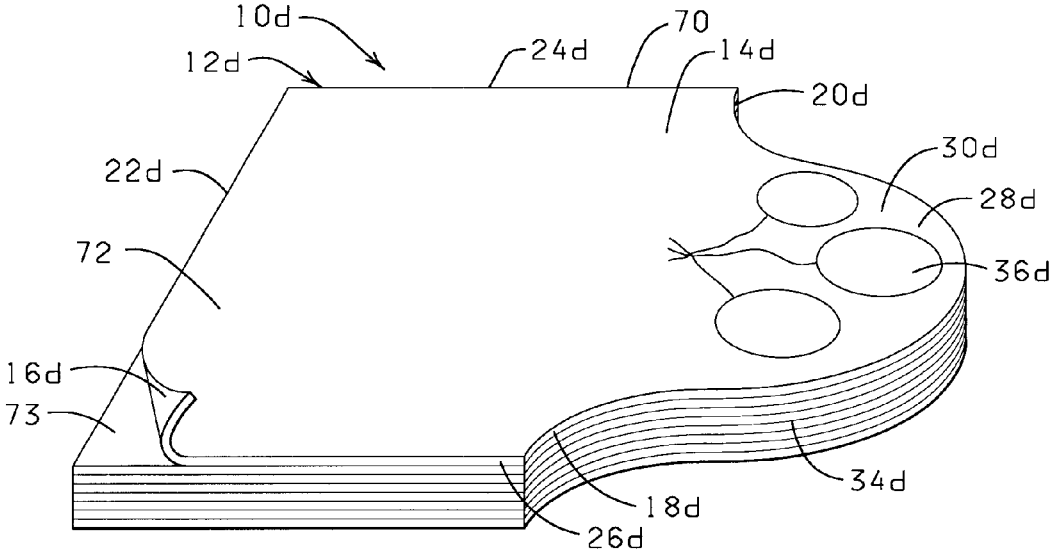
FIG. 8 is a perspective view of a modified wrapping material constructed exactly like the wrapping material of FIG. 3, but showing a plurality of sheets of material formed into a pad.

The Embodiment of FIG. 8

Illustrated in FIG. 8 is a modified wrapping material 10*d* which is constructed exactly like the wrapping material 10 shown in FIGS. 1–2, and described in detail previously, except that the sheet of material 12*d* comprises a plurality of sheets of material 12*d* connected together to form a pad 70 of sheets of material 12*d*, and the extension 28*d* forms an integral part of the sheet of material 12*d*. The pad 70 comprises a plurality of sheets of material 12*d* stacked one on top of the other and positioned so that the periphery 18*d*, that is, the first sides 20*d*, the second sides 22*d*, the third sides 24*d*, and the fourth sides 26*d* of sheets of material 12*d* in the pad 70 generally are aligned.

Referring to FIG. 8, the pad 70 further comprises a top sheet of material 72 and a next sheet of material 73 disposed thereunder, the other sheets of material 12*d* being disposed under the next sheet of material 73 in the pad 70 of sheets of material 12*d*. Each sheet of material 12*d* in the pad 70 may have a bonding material 68 (not shown) disposed thereupon, near at least a portion of the periphery 18*d* of each sheet of material 12*d*, and each sheet of material 12*d* having a bonding material 68 thereon is bondingly connectable to a portion of another sheet of material 12*d* for cooperating to connect each of the sheets of material 12*d* into the pad 70. It will also be appreciated that each sheet of material 12*d* in the pad has an extension 28*d* which comprises an integral part of the sheet of material 12*d*. Alternatively, each sheet of material 12*d* in the pad may comprise a separate extension 28*d* which is bondingly attached and bondingly releasable from each sheet of material 12*d* in the pad 70 (not shown). In a further alternative, the extension 28*d* may comprise a separate pad 70 of extensions 28*d*, which are bondingly attached and bondingly releasable from each extension 28*d* in the pad 70, as described previously for the sheet of material 12*d* (not shown). In this alternative, the extension 28*d* would be attached separately to the sheet of material 12*d*.

The top sheet of material 72 is capable of being disconnected from the pad 70 of sheets of material 12*d*. When the top sheet of material 72 is disconnected, the next sheet of material 73 forms the new top sheet of material 72, and the sheet of material 12*d* lying under the new top sheet of material 72 forms a new next sheet of material 73.

A bonding material 68 (not shown) on each sheet of material 12*d* bondingly and releasably connects each sheet of material 12*d* to one other sheet of material 12*d* whereby one of the sheets of material 12*d* can be releasably disconnected from another sheet of material 12*d* by pulling the sheets of material 12*d* apart. Further, the bonding material bondingly and releasably may connect each sheet of material 12*d* to portions of itself.

Figure 9:
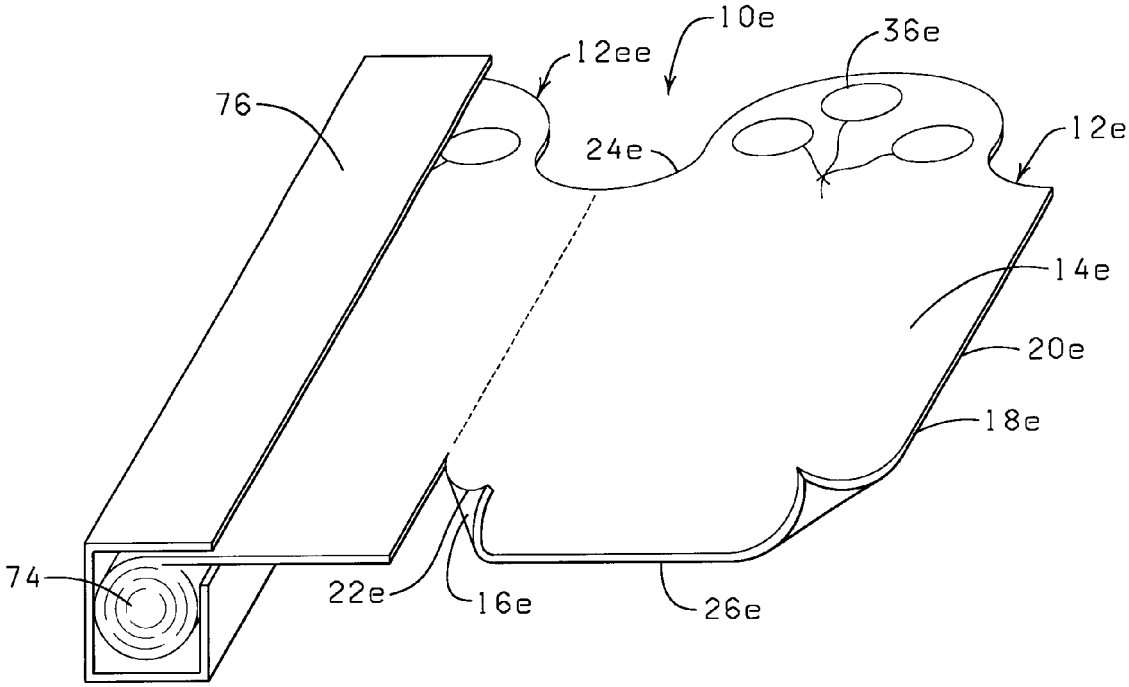
FIG. 9 is a perspective view of a modified wrapping material constructed exactly like the wrapping material of FIG. 3, but showing a plurality of sheets of material contained within a roll of sheets of material which is contained within a dispenser.
Figure 10:
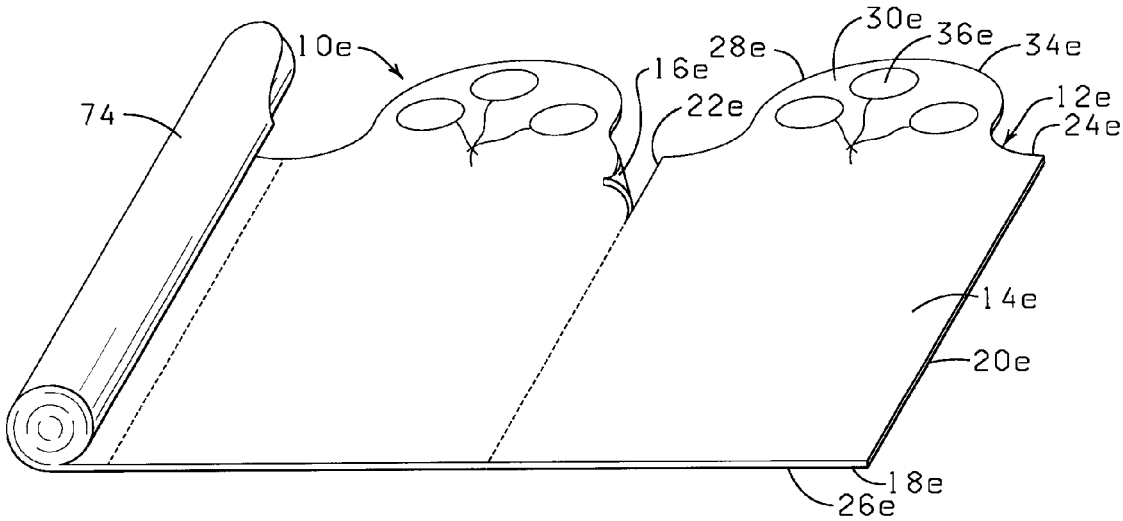
FIG. 10 is a perspective view of a modified wrapping material constructed exactly like the wrapping material of FIG. 3, but showing a plurality of sheets of material contained within a roll.
Figure 11:
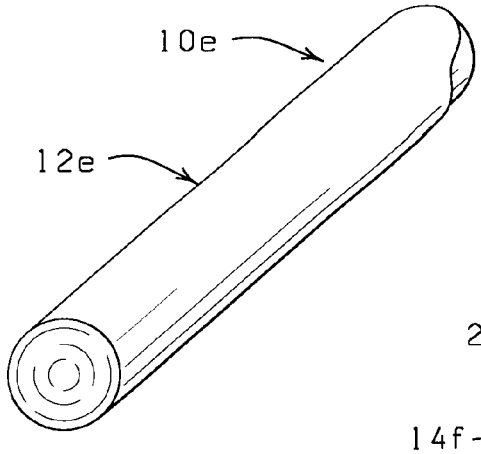
FIG. 11 is a perspective view of a modified wrapping material constructed exactly like the wrapping material of FIG. 3, but showing a single sheet of material contained within a roll.
Figure 12:
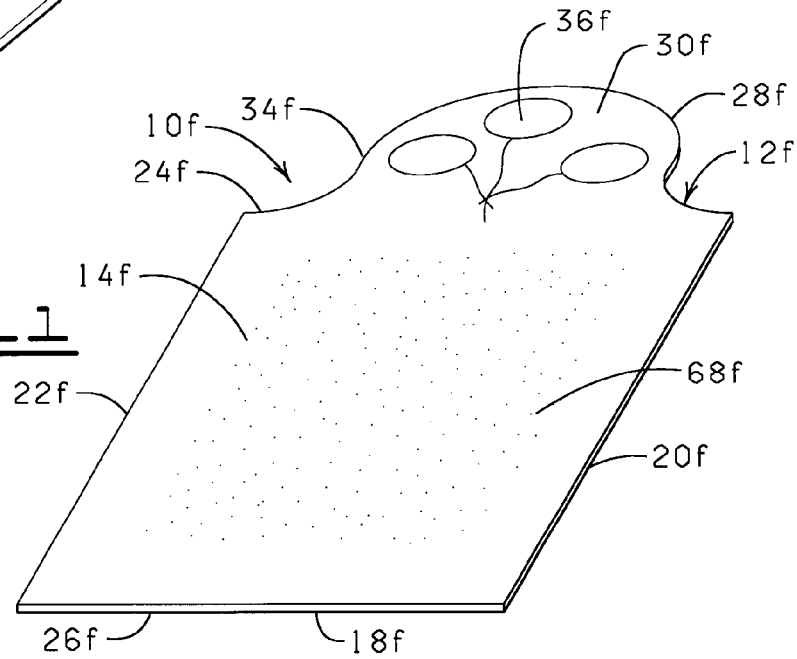
FIG. 12 is a perspective view of a modified wrapping material constructed exactly like the wrapping material of FIG. 3, but showing a bonding material disposed thereon.

The Embodiments of FIGS. 9–11

Illustrated in FIGS. 9–11 is a modified wrapping material 10*e* which is constructed exactly like the wrapping material 10 shown in FIGS. 1–2, and described in detail previously, except that the wrapping material 10*e* comprises a roll 74 of sheets of material 12*e* contained within a dispenser 76 as shown in FIG. 9. The roll 74 contains a wrapping material 10*e* comprising a plurality of sheets of material 12*e* in the roll 74, the sheets of material 12*e* being connected by perforations to form the roll 74 (the sheet of material 12*e* and 12*ee* shown partially detached and turned upward for illustration purposes only). Such a roll 74 may be provided without a dispenser 76 as well (FIG. 10). Such rolls 74 permit one sheet of material 12*e* to be withdrawn from the roll 74, and the sheet of material 12*e* is detached or severed from the roll 74. Alternatively, the roll 74 may simply be formed as a continuous roll 74 without perforations, and the wrapping material 10*e* may be withdrawn from the roll 74 and a portion may be severed into separate sheets of material 12*e* by a serrated cutting edge (not shown) contained within the dispenser 76, or by a separate cutting element (not shown). Any number of sheets of material 12*e* may form the roll 74 as long as it is possible to withdraw at least one sheet of material 12*e* from the roll 74. It will be understood that the roll 74 may comprise only one sheet of material 12*e*, without the dispenser 76, as illustrated in FIG. 11.

It will also be understood that the sheet of material 12*e*, or plurality of sheets of material 12*e* which comprises the roll 74, whether or not contained within a dispenser 76, may contain, as an integral part of the sheet of material 12*e* an extension 28*e*, as shown in FIG. 10. It will also be understood that an extension 28*e* may be provided and attached to the sheet of material 12*e* separately. The sheet of material 12*e* may be wrapped about a floral arrangement 50 or a flower pot 38. The sheet of material 12*e*, when wrapped about either a floral arrangement 50 or a flower pot 38, substantially wraps and encompasses the floral arrangement 50 or flower pot 38. Both of these methods of use are described in detail below.

The Embodiment and Method of Use of FIGS. 12–15

FIGS. 12–15 illustrate another embodiment and method of use of the present invention. The wrapping material 10*f* and sheet of material 12*f* illustrated in this embodiment and used in this method are constructed exactly the same as the wrapping material 10*a* and the sheet of material 12*a* shown in FIG. 3 and described in detail previously, except that a bonding material 68*f* is disposed on at least a portion of the upper surface 14*f* of the sheet of material 12*f*.

After the sheet of material 12*f* is withdrawn and detached from a roll 74 or a pad 70 of sheets of material 12*f* by any means described herein, an operator disposes the sheet of material 12*f* on a relatively horizontal surface (not shown), the lower surface 16*f* of the sheet of material 12*f* contacting the horizontal surface.

Figure 13:
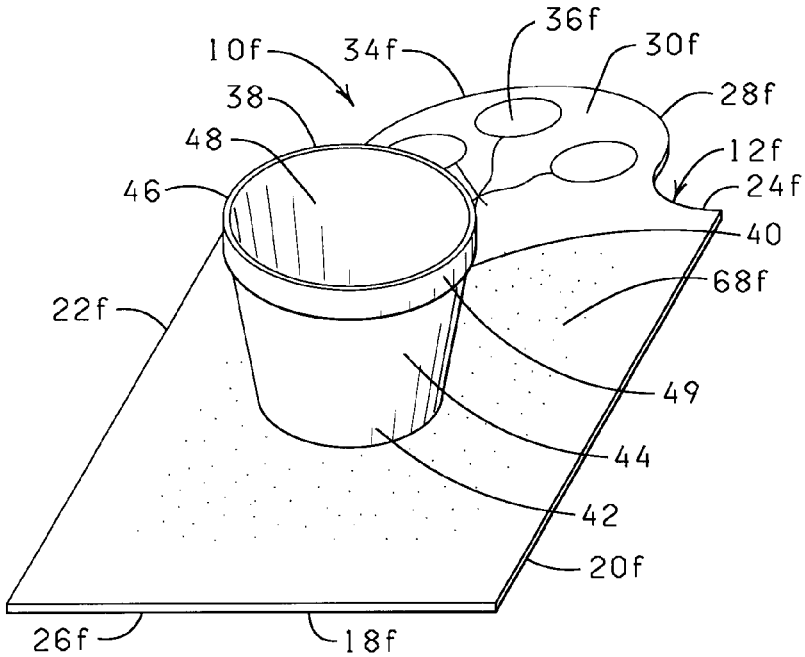
FIG. 13 is a perspective view of the wrapping material of FIG. 12, but showing a flower pot disposed thereupon.
Figure 14:
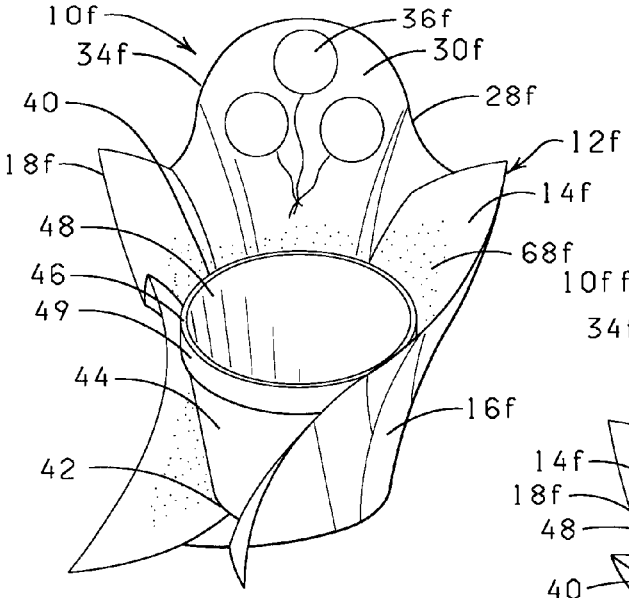
FIG. 14 is a perspective view of the wrapping material of FIG. 12, but showing a partially wrapped flower pot.
Figure 15:
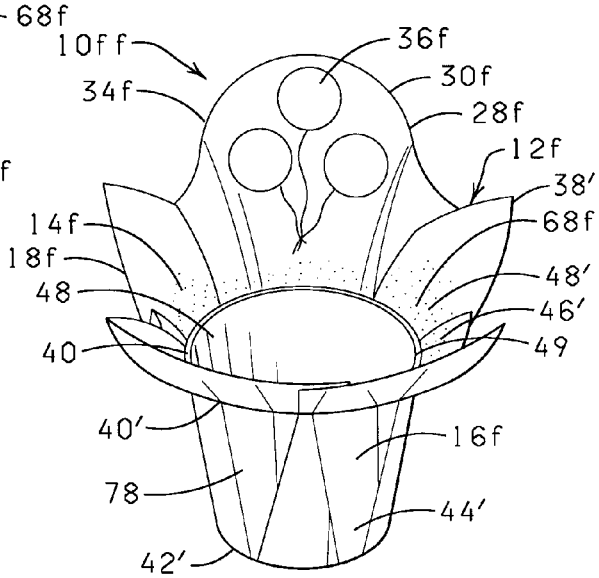
FIG. 15 is a perspective view of the wrapping material of FIG. 12, but showing a wrapped flower pot.
Figure 16:
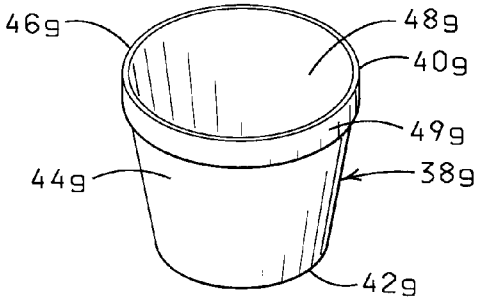
FIG. 16 Prior Art
FIG. 16 is a perspective view of a flower pot.
Figure 17:
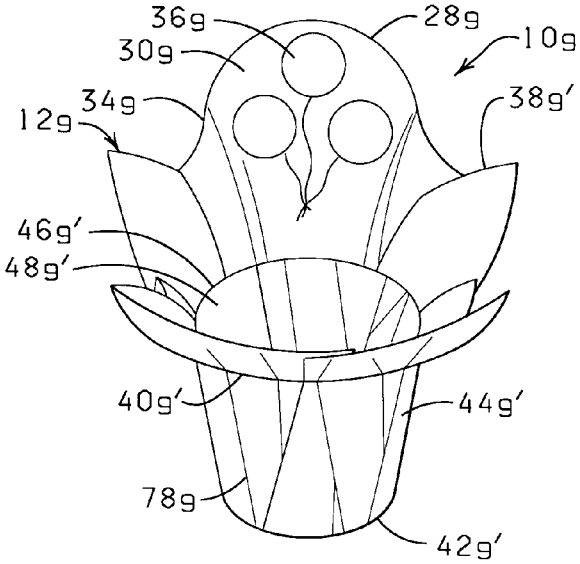
FIG. 17 is a perspective view of a pre-formed flower pot cover constructed from wrapping material exactly like the wrapping material shown in FIG. 3.
Figure 18:
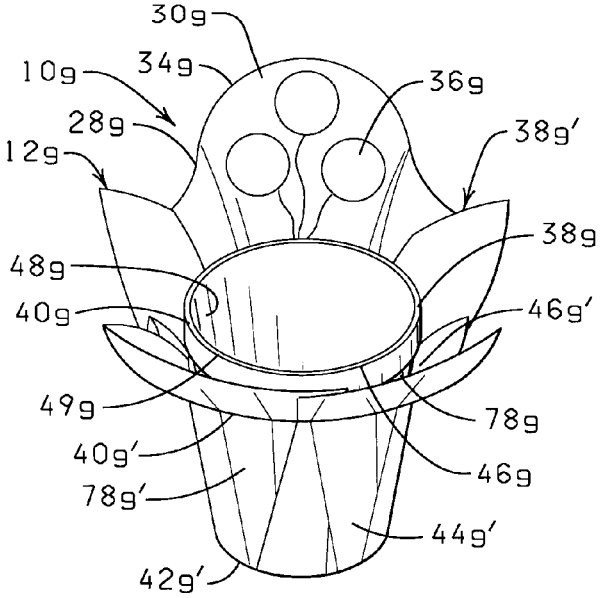
FIG. 18 is a perspective view of the pre-formed flower pot cover of FIG. 17, but showing a flower pot partially disposed therein.
Figure 19:
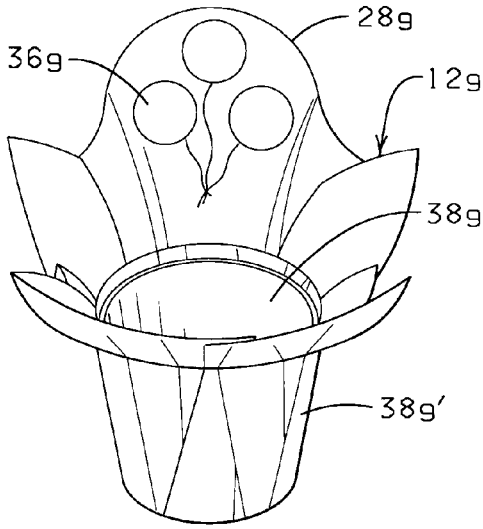
FIG. 19 is a perspective view of the pre-formed flower pot cover of FIG. 17, but showing a flower pot disposed in the pre-formed flower pot cover.

Next, a flower pot 38 is provided, and the operator disposes the flower pot 38 on the upper surface 14*f* of the sheet of material 12*f* as shown in FIG. 13. The sheet of material 12*f* is then wrapped around the flower pot 38 by being formed and molded in an upward direction around the flower pot 38 by the operator as shown in FIGS. 14 and 15, at least one portion of the sheet of material 12*f*, such as the upper surface 14*f* and the bonding material 68*f* thereon contacts at least one other portion of the upper surface 14*f*, to form and shape the sheet of material 12*f* about the flower pot 38, the sheet of material 12*f* capable of retaining a wrapped shape. The sheet of material 12*f* is formed about the flower pot 38 and the sheet of material 12*f* forms a flower pot cover 38'. The formed flower pot cover 38' has an upper end 40', a lower end 42', and an outer surface 44', an opening 46' being formed in the flower pot cover 38 with a portion of the opening 46' intersecting the upper end 40' of the flower pot cover 38' forming an inner surface 48', the extension 28*f* of the sheet of material 12*f* and the design indicia 36*f* thereon forming a portion of the upper end 40' of the flower pot cover 38' adjacent said opening, 40', wherein the flower pot cover 38' substantially surrounds and encompasses the flower pot 38, the flower pot opening 46 in corresponding alignment with the opening 46' in the flower pot cover 38' wherein a floral arrangement 50 or a potted plant 52 retained within the flower pot 38 is exposed through both the flower pot opening 46 and the flower pot cover opening 46'. The sheet of material 12*f* having an extension 28*f* with design indicia 36*f* thereon may extend generally a distance above the opening 46 in the flower pot 38. Alternatively, however, the extension 28*f* will not extend above the sheet of material 12*f* when formed into a flower pot cover 38'. It will be appreciated, however, that the sheet of material 12*f* may be pre-formed into a flower pot cover 38', by hand or by any means known in the art, before the sheet of material 12*f* is disposed about the flower pot 38.

Therefore, alternatively, the flower pot 38 is inserted by an operator into a pre-formed flower pot cover 38' constructed from the sheet of material 12*g* (as illustrated in FIGS. 16–19), the pre-formed flower pot cover 38' retaining its pre-formed shape, and substantially surrounding and encompassing the flower pot 38, as previously described, as well be described in further detail below. Methods of using sheets of material 12*f* to form into flower pot covers 38', and methods of making pre-formed flower pot covers 38' are covered in U.S. Pat. No. 4,773,182, entitled, "Article Forming System," and U.S. Pat. No. 4,897,031, entitled, "Article Forming System," both of which are hereby incorporated by reference herein.

It will also be appreciated that the base 78 of the flower pot cover 38' may vary in size and/or in shape. The "base," as used herein, means the portion of the flower pot cover 38' which surrounds the outer surface 44 of the flower pot 38 illustrated in FIGS. 14 and 15. These areas extend generally between the lower end 42' and the upper end 40' of the flower pot cover 38', and about the outer surface 44', and sometimes follows the contours of the outer surface 44 of the flower pot 38 (in this instance, the frusto-conical shape of the flower pot 38), before extending, as shown in FIG. 14 and is outward, into a skirt. The base 78 of the flower pot cover 38' may be frusto-conical, round, cylindrical, reverse frusto-conical (an upside-down frusto-conical shape), or the base 78 of the flower pot cover 38' may have three sides, four sides, five sides, six sides, seven sides, eight sides, nine sides, ten sides, eleven sides, twelve sides, or any number of sides, or, alternatively, the base of the flower pot cover, 38' may have a scalloped shape, a sinusoidal shape, a corrugated shape, an asymmetrical shape, or may comprise any combination of the shapes shown and/or described herein, or known in the art.

It will be understood that the extension 28*f*, shown as an integral part of the sheet of material 12*f* formed into a flower pot cover 38', and as an integral part of the flower pot cover 38', can be formed separately and attached separately to the sheet of material 12*f*, either before or after the sheet of material 12*f* is formed into a flower pot cover 38', as previously described, and as will be discussed in further detail below.

The Embodiments and Method of Use of FIGS. 16–19

In alternative embodiments and method shown in FIGS. 16–19, a flower pot 38*g* and a pre-formed flower pot cover 38*g'* constructed from (and exactly the same as) the wrapping material 10*a* and the sheet of material 12*a* shown in FIG. 3 and previously described in detail, is provided. The operator disposes the performed flower pot cover 38*g'* (formed by any method described herein) on a relatively horizontal surface (not shown). The operator then takes the flower pot 38*g* and inserts the flower pot 38*g* into the opening 46*g'* provided in the pre-formed flower pot cover 38*g'* to receive the flower pot 38*g*, the pre-formed flower pot cover 38*g'* substantially surrounding and encompassing the outer surface 44*g* of the flower pot 38*g*, as previously described herein.

In an alternative embodiment (not shown), the sheet of material 12*g* is a pre-formed flower pot 38*g*, instead of a performed flower pot cover 38*g'*. In this embodiment, a flower pot 38*g* is formed from a wrapping material 10*g*, as described herein, capable of forming and retaining the shape of a flower pot 38*g* for inserting a floral arrangement 50 or a plant 52 into. The flower pot 38*g* is formed from a sheet of material 12*g*. The sheet of material 12*g* is sized to form a flower pot 38*g*, the sheet of material 12*g* capable of retaining the pre-formed shape of a flower pot 38*g*, wherein the sheet of material 12*g* is pre-formed into a flower pot 38*g* having an upper end 40*g*, a lower end 42*g*, and an outer surface 44*g*, an opening 46*g* being formed in the flower pot 38*g* with a portion of the opening 46*g* intersecting the upper end 40*g* of the flower pot 38*g* forming an inner surface 48*g*, the extension 28*g* of the sheet of material 12*g* and the design indicia 36*g* thereon forming a portion of the upper end 40*g'* of said flower pot cover 38*g'* adjacent said opening 46*g*, the flower pot opening 46*g* being sized and shaped for receiving and containing a floral arrangement 50 or a plant 52 therein, said floral arrangement 50 or plant 52 being retained in the opening 46*g* of the flower pot 38*g*, wherein the flower pot 38*g* substantially surrounds and encompasses the floral arrangement 50 or the plant 52, and wherein at least a portion of a floral arrangement 50 or plant 52 retained within the flower pot 38*g* is exposed through the opening 46*g*.

The flower pot 38*g* also has a 78*g'*, which is exactly the same as the base 78 described above for a flower pot cover, which may also vary in shape and configuration, as previously described for the "base" of the flower pot cover 38'.

It will be understood that the extension 28*g*, shown as in integral part of the pre-formed flower pot cover 38*g'*, and as an integral part of the pre-formed flower pot 38*g*, can be attached separately to either the pre-formed flower pot cover 38*g'* or the flower pot 38*g*, either before or after a floral arrangement 50 or potted plant 52 is disposed therein.

The method of use of this alternate embodiment (not shown) is similar to the one described above. In this instance, a floral arrangement 50 or a plant 52 is disposed into a flower pot 38*g*.

A flower pot 38*g* formed from the wrapping material 10*g* capable of forming and retaining the shape of a flower pot

38*g* for disposing a floral arrangement 50 or plant 52 into is provided. The flower pot 38*g* is formed from a sheet of material 12*g*, as described above. A floral arrangement 50 or a plant 52 sized to be disposed in the flower pot opening 46*g* is provided. An operator then disposes the floral arrangement 50 or the plant 52 into the opening 46*g* of the flower pot 38*g*, the flower pot 38*g* receiving and retaining the floral arrangement 50 or plant 52 therein, the flower pot 38*g* substantially surrounding and encompassing a substantial portion of the floral arrangement 50 or plant 52, the flower pot 38*g* retaining the floral arrangement 50 or the plant 52 adjacent the inner surface 48*g* of the flower pot 38*g*, wherein at least a portion of the floral arrangement 50 or the plant 52 retained within the flower pot 38*g* is exposed through the opening 46*g* in the flower pot 38*g* and wherein the extension 28*g* and the design indicia 36*g* thereon extends generally a distance above the opening 46*g* in the flower pot 38*g*. Alternatively, however, the extension 28*g* will not extend above the flower pot 38*g*.

Potting soil, floral foam, or any other material used to encompass live floral arrangements or plants, or, cut floral arrangements or plants may also be disposed, along with the floral arrangement 50 or plant 52 in the flower pot 38*g*, such material being disposed through the opening 46*g* in the flower pot 38*g* and being retained adjacent the inner surface 48*g* the flower pot 38*g*. Such potting soil, floral foam, and like materials are well known in the art, and are commercially available.

The Embodiment and Method of FIGS. 20–21

FIGS. 20–21 illustrate another embodiment and method of use of the present invention. The wrapping material 10*h* and sheet of material 12*h* illustrated in this embodiment and used in this method are constructed exactly the same as the wrapping material 10*c* and the sheet of material 12*c* shown in FIG. 7 and described in detail previously.

The sheet of material 12*h* (which may be provided in pads 70 of sheets of material 12, as previously described herein) is provided. The sheet of material 12*h* is disposed about a flower pot 38*h* by wrapping the sheet of material 12*h* about the flower pot 38*h*, to, in a preferable embodiment, conform to the outer surface 44*h* of the flower pot 38*h*, as shown in FIGS. 20–21. The sheet of material 12*h* wraps about and is adjacent to the outer surface 44*h* of the flower pot 38*h*. The bonding material 68*h* on the sheet of material 12*h* connects to the sheet of material 12*h* to secure the sheet of material 12*h* about the flower pot 38*h*.

The sheet of material 12*h* may also have a special area 79 provided for a personalized message to be written or printed on the sheet of material 12*h*, to act as a greeting to the recipient. "Special area" means a portion of the surface of the sheet of material 12*h* (either the upper surface 14*h* or the lower surface 16*h*, whichever does not lie adjacent to the flower pot 38*h*) which permits writing or printing thereon. Such surfaces, formed from various material described herein, are well-known in the art. Further, it will be appreciated that all embodiments described and illustrated herein may also be provided with a special area 79.

The Embodiment and Method of Use of FIGS. 22–25

FIGS. 22–25 illustrate another embodiment and method of use of the present invention. The sheet of material 12*i* and the extension 28*i* illustrated in this embodiment and used in this method of use are constructed exactly the same as the sheet of material 12*b* and extension 28*b* shown in FIGS. 4–6 and described in detail previously, except that a bonding material 68*i* has been disposed on at least a portion of the upper surface of the sheet of material 12*i*, and except that the sheet of material 12*i* may be performed into a flower pot cover 38*i*', as previously described herein.

The sheet of material 12*i* is disposed on a surface, and is formed by hand about a flower pot 38*i* (FIGS. 22 and 23), or is pre-formed into the shape of a flower pot cover 38*i*' (FIG. 23), and the flower pot 38*i* is disposed into the flower pot cover 38*i*', as previously described herein. The extension 28*i* is then applied to the flower pot cover 38*i*' to secure the flower pot cover 38*i*' about the flower pot 38*i*, at least one portion of the extension 28*i* contacting, or overlapping at least one other portion of the extension 28*i*, to secure the flower pot cover 38*i*' about the flower pot 38*i* (FIGS. 24–25). Alternatively, at least one portion of the extension 28*i* should extend substantially around the flower pot cover 38*i*'.

It will be appreciated that when the sheet of material 12*i* is formed by hand about a flower pot 38*i*, the sheet of material 12*i* may not sustain the shape of a flower pot cover 38*i*' without the application of the extension 28*i*, which secures the sheet of material 12*i* about the flower pot 38*i*, and bondingly restricts, via the bonding material 68*i*, the shape of the sheet of material 12*i*, causing the sheet of material 12*i* to retain the shape of a flower pot cover 38*i*' while the extension 28*i* is bondingly engaged with the sheet of material 12*i*. It will also be understood that this result is also achieved when an extension 28*i* is used to secure a sheet of material 12*i* about a flower pot 38*i* when the sheet of material 12*i* has no bonding material 68*i* disposed thereon.

The extension 28*i* may wrap around the flower pot cover 38*i*' at or near the rim 49*i* of the flower pot 38*i* (FIG. 25) or, the extension may wrap around the flower pot cover 38*i*' above the level of the opening 46*i* in the flower pot 38*i* (above the rim 49*i* of the flower pot 38*i*) (not shown). The extension 28*i* may also wrap the sheet of material 12*i* below the rim 49*i* of the flower pot 38*i* (FIG. 25). It will be appreciated that the extension 28*i* may have one or more portions which wrap about the sheet of material 12*i* (FIGS. 24–25).

Finally the extension 28*i* may be used to wrap about only a flower-pot 38*i* (not shown). Or, alternatively, the extension 28*i* may be used to wrap about a sheet of material which is formed, by any method disclosed herein, into a flower pot.

The Embodiments and Method of Use of FIGS. 26–29

In a general method of use of the embodiments illustrated in FIGS. 26–29, the wrapping material 10*j* comprises a plurality of sheets of material 12*j* in pad 70*j* and a floral arrangement 50*j*, as previously described, are provided. The wrapping material 10*j* and the sheet of material 12*j* are constructed exactly like the wrapping material 12*d* and sheet of material 10*d* shown in FIG. 8 and described in detail previously, except that the sheet of material 12*j* also has a bonding material 68*j* disposed thereon. The floral arrangement 50*j* is placed on a sheet of material 12*j* in the pad 70*j*, the sheet of material 12*j* being sized to wrap about and substantially surround and encompass a floral arrangement 50*i*. The sheet of material 12*j* is wrapped about the floral arrangement 50*j*, the sheet of material 12*j* simultaneously disconnecting from the pad 70*j* of sheets of material 12*j* as the sheet of material 12*j* is wrapped about the floral arrangement 50*j*. A portion of the sheet of material 12*j*, such as the second side 22*j* of the sheet of material 12*j*, overlaps at least one other portion of the sheet of material 12*j*. The overlapping portions of the sheet of material 12*j* are bonded to the sheet of material 12*j* by their contact with the bonding material 68*j* on the upper surface 14*j* which bondingly connects to the overlapping portions of the sheet of material 12*j*, whereby the second side 22*j* of the sheet of material 12*j* is bonded to overlapping portions of the sheet of material 12*j* generally between the third side 24*j* and the fourth side 26*j* of the sheet of material 12*j* whereby there are no loose flaps formed by unbonded portions of the sheet of material 12*j*. The sheet of material 12*j* substantially encompasses and surrounds a substantial portion of the flower portion 50*j* of the floral arrangement 50*j* and a substantial portion of the stem portion 56*j* of the floral arrangement 50*j* The sheet of material 12*j* is held about the floral arrangement 50*j* by the bonding of the overlapping portions of the sheet of material 12*j*, the sheet of material 12*j* being tightly wrapped about the stem portion 56*j* the floral arrangement 50*j* , the extension 28*j* of the sheet of material 12*j* and the design indicia 36*j* thereon extending generally a distance above the flower portion 34*j* of the floral arrangement 50*j* . However, it will be appreciated that the extension 28*j* in an alternative embodiment, may not extend above the flower portion 34*i*' of the floral arrangement 50*j*.

The sheet of material 12*j* wrapped about the floral arrangement 50*j* forms a wrapping which may be a cylindrically shaped wrapping (FIG. 29) or which may be a conically-shaped wrapping, or which may comprise other geometric forms (square, rectangular, and the like) or non-geometric or asymmetrical formed wrappings. The wrapping has an opening extending through a lower end 80 thereof and an opening extending through the upper end 82 thereof with the stem portion 56*j* of the floral arrangement 50*j* extending through the opening in the lower end 80 and the flower portion 54*j*of the floral arrangement 50*j* being exposed near the opening in the upper end 82 thereof, the upper end 82 of the wrapping being loosely wrapped about the flower portion 54*j* of the floral arrangement 50*j*.

Figure 27:
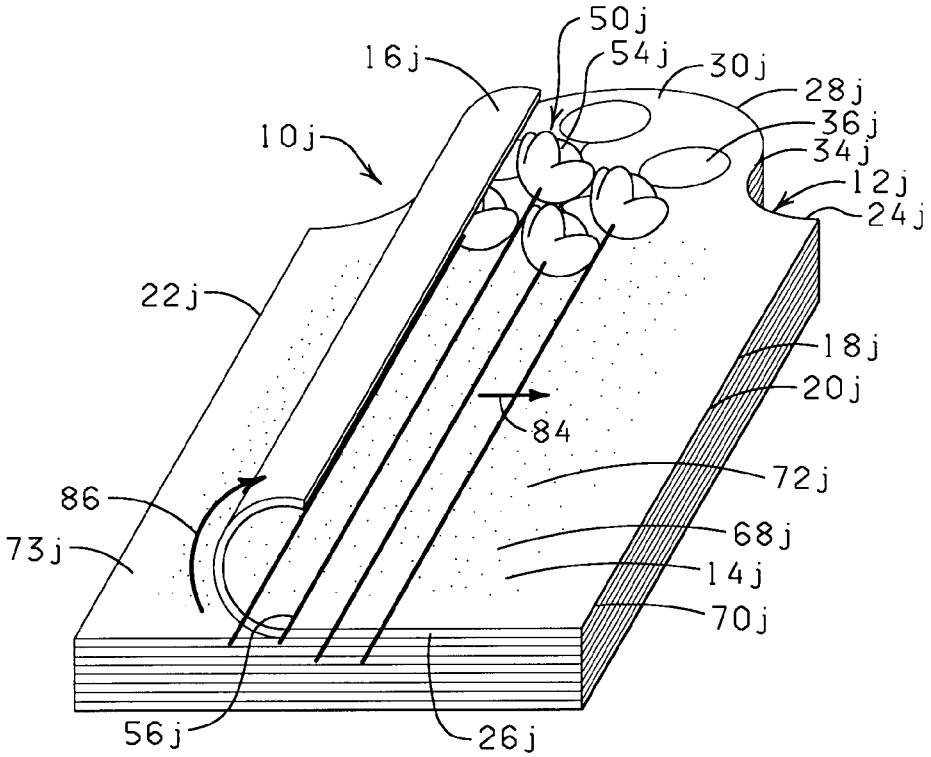
FIG. 27 is a perspective view of the wrapping material of FIG. 26, but showing a partially wrapped floral arrangement.

FIGS 26–29 show one specific method of use. A plurality of sheets of material 12*j* in a pad 70*j*, and a floral arrangement 50*j* as described above, are provided. A floral arrangement 50*j* is disposed on the top sheet of material 72*j* in a pad 70*j* of sheets of material 12*j*. An operator then lifts a portion of the top sheet 72*j* (generally the portion near the second side 22*j*) and places the lifted portion over a portion of the floral arrangement 50*j*, as shown in FIG. 27. In this position, the top sheet of material 72*j* is rolled over the floral arrangement 50*j* , and the top sheet of material 72*j* and the floral arrangement 50*j* are then rolled in a general direction 84 (FIGS. 27–28), whereby the top sheet of material 72*j* and the floral arrangement 50*j* contained therein are lifted from the next sheet of material 73*j*, the floral arrangement 50*j* being rolled into the top sheet of material 72*j*, thereby rolling the top sheet of material 72*j* generally about the floral arrangement 50*j* and containing and substantially encompassing the floral arrangement 50*j* , within the top sheet of material 72*j*.

Figure 28:
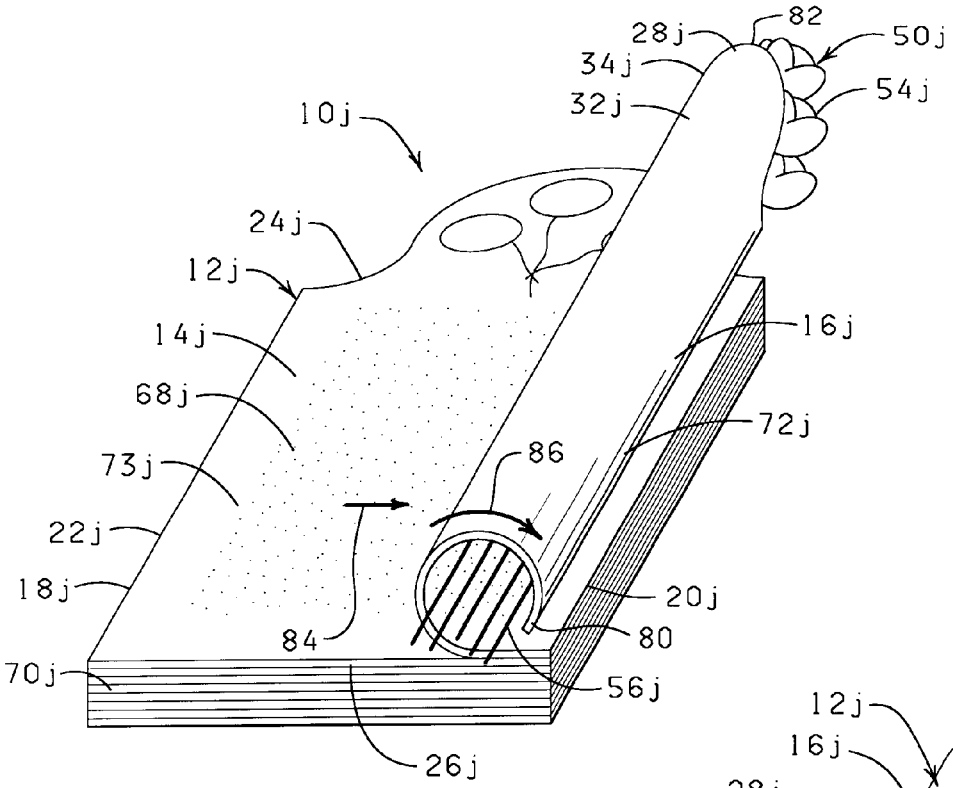
FIG. 28 is a perspective view of the wrapping material of FIG. 27, but showing a partially wrapped floral arrangement.
Figure 29:
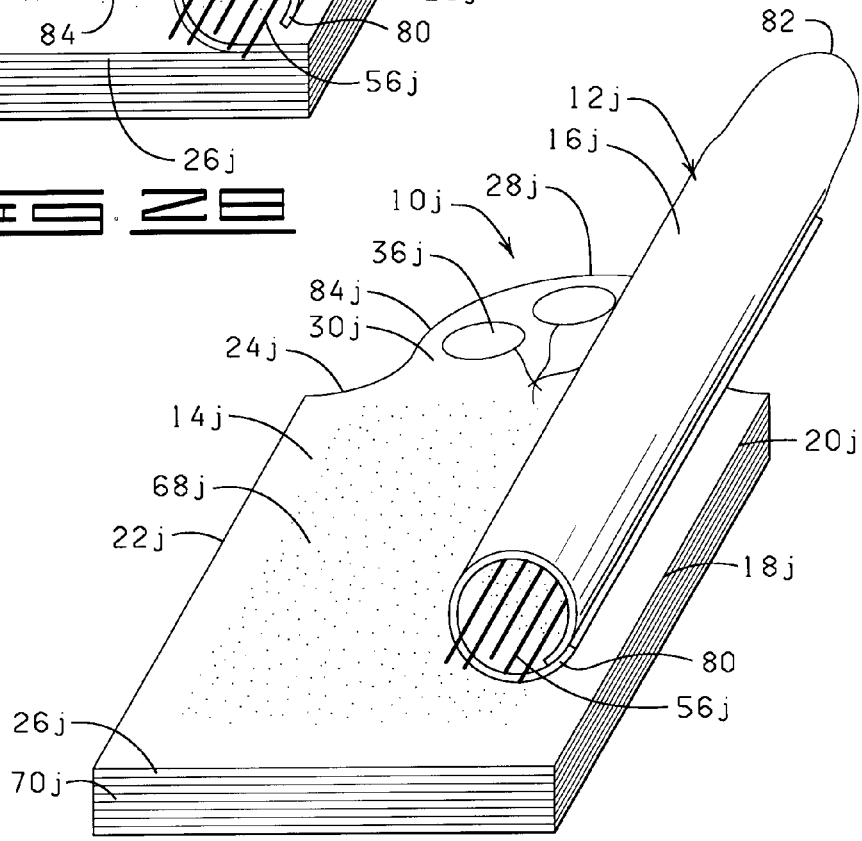
FIG. 29 is a perspective view of the wrapping material of FIG. 27, but showing a wrapped floral arrangement.

The top sheet of material 72*j* and the floral arrangement 50*j* are continually rolled in a rolling direction 86. and in the direction 84 generally toward the first side 20*j* of the top sheet of material 72*j* until the floral arrangement 50*j* is disposed generally adjacent the first side 20*j* of the top sheet of material 72*j*, as shown in FIG. 28. In this position, the operator continues to roll the top sheet of material 72*j* and the floral arrangement 50*j* disposed thereon in the rolling direction 86 and in the general direction 84 thereby lifting the top sheet of material 72*j* from the next sheet of material 73*j* and the bonding material 68*j* thereon, the next sheet of material 73*j* generally beneath the top sheet of material 72*j* and simultaneously disconnecting the top sheet of material 72*j* from the bonding material 68*j* connection between the top sheet of material 72*j* and the next sheet of material 73*j*. The adjacent lower surface 16*j* of the second side 22*j* of the top sheet of material 72*j* is then bondingly connected to the bonding material 68*j* on the upper surface 14*j* of the top sheet of material 72*j* thereby securing the top sheet of material 72*j* and securely wrapping the floral as arrangement 50*j* as shown in FIG. 29.

When the top sheet of material 72*j* has been secured about the floral arrangement 50*j* in the manner just described, the next sheet of material 73*j*, generally under the top sheet of material 72*j*, then provides a new top sheet of material 72*j*, the sheet of material 12*j* under the new top sheet of material 72*j* providing a new next sheet of material 73*j*, and the process can be repeated for wrapping additional or other floral groupings.

It will be appreciated that the sheet of material 12*j* used to wrap a floral arrangement 50*j* may be provided, as described above, as a top sheet of material 72*j* in a pad 70*j* of sheets of material 12*j*, or as a single sheet of material 12*j* severed from a roll 74*j* a sheet of material 12*j* removed from a roll 74 of sheets of material l2*j* in a dispenser 76*j* (FIG. 9 showing a sheet of, material partially detached), a single sheet of material 12*j* (FIG. 1), or as one or more sheets of material 12*j* rolled into a roll (FIG. 11).

Figure 30:
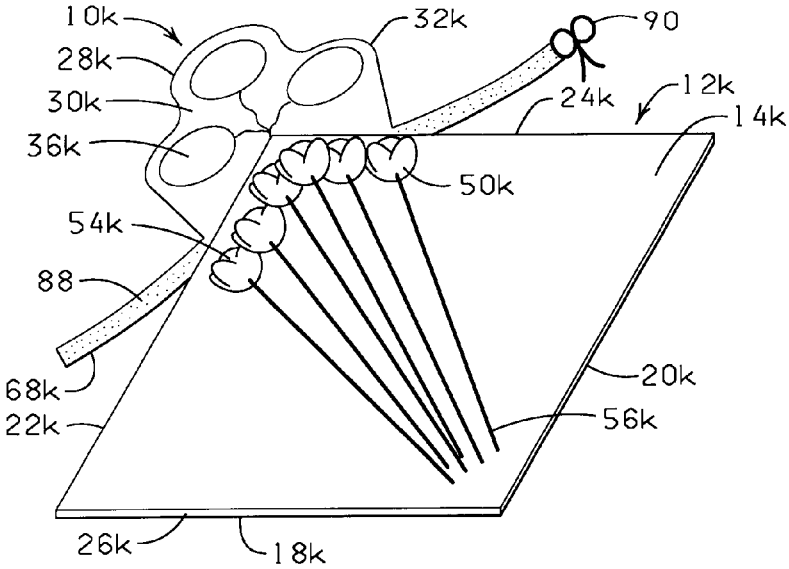
FIG. 30 is a perspective view of a modified wrapping material constructed exactly like the wrapping material of FIGS. 1–2, but showing an extension which is attached separately, and showing the upper surface of a portion of the extension, the extension being a different configuration than the extension shown in FIGS. 1–2, and having a first portion and a second portion which extend beyond the outer periphery of the wrapping material, a floral arrangement disposed on the wrapping material.
Figure 31:
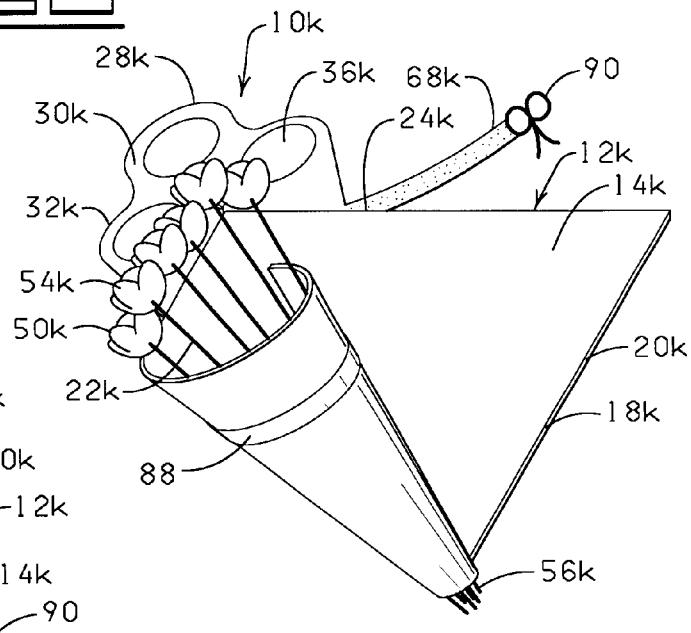
FIG. 31 is a perspective view of the wrapping material of FIG. 30, showing a partially wrapped floral arrangement.
Figure 32:
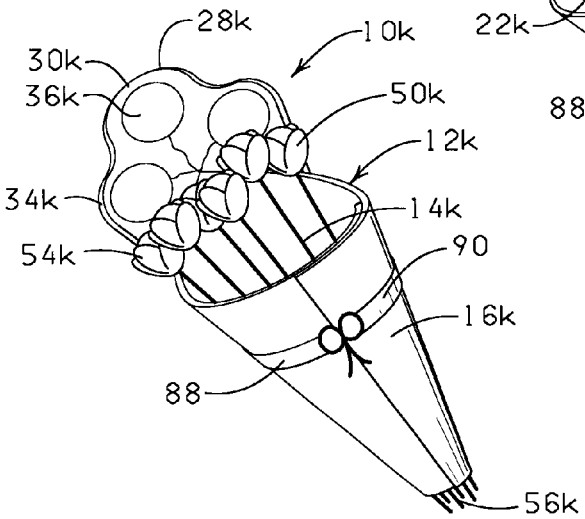
FIG. 32 is a perspective view of the wrapping material of FIG. 30, showing a wrapped floral arrangement.

The Method of Use of FIGS. 30–32

FIGS. 30–32 illustrate another embodiment and method of use of the present invention. The wrapping material 10*k* and the sheet of material 12*k* shown in this embodiment and used in this method is constructed exactly the same as the wrapping material 10 and the sheet of material 12 shown in FIGS. 1–2, except that the extension 28*k* has a first portion 88 and a second portion 90 which extend beyond the first side 20*k* and the second side 22*k* of the sheet of material respectively, and except that the extension 28*k* is disposed at the junction of the second side 22*k* and the third side 24*k* of the sheet of material 12*k*. A floral arrangement 50*k* is disposed upon the sheet of material 12*k*, the floral arrangement 50*k* placed diagonally upon the upper surface 14*k* of the sheet of material 12*k* , as shown in FIG. 30.

The sheet of material 12*k* is then wrapped in a manner similar to the one described above for the sheet of material 12*j*. The only difference being that the floral arrangement 50*k* is disposed diagonally on the sheet of material 12*k* , that is, the flower portion 54*k* is disposed near the junction of the second side 22*k* and the third side 24*k* of the sheet of material, and the stem portion 56*k* is disposed near the junction of the first side 20*k* and the fourth side 26*k* of the sheet of material 12*k*. The second side 22*k* is lifted near the corner of its junction with the fourth side 26*k* , and is placed at a diagonal angle across the floral arrangement 50*k* , as shown in FIG. 31. The sheet of material 12*k* is then rolled in a manner identical to that previously described for the top sheet of material 72*j* except that the sheet of material 12*k* does not release from a next sheet of material 73*j*. The wrapping which is formed from the sheet of material 12*k* substantially surrounds and encompasses the floral arrangement 50*k*, as previously shown and described above in detail, except that the wrapping forms a conical, or, alternatively, a frusto-conically shaped wrapping. It will be appreciated however, that the wrapping may form other shapes, such as cylindrical, or other geometric, non-geometric, or asymmetrical forms, as previously.

While the sheet of material 12*k* does not have a bonding material thereon, and will not bondingly connect and bond to like portions of the sheet of material 12*k*, the sheet of material 12*k* still acts to substantially wrap and encompass the floral arrangement, due to the bonding material 68*k* disposed on at least a portion of the upper surface 30*k* of the extension 28*k* on the first portion 88 and the second portion 90, which bondingly connects to the sheet of material 12*k* to hold the sheet of material 12*k* in the wrapped form.

It will be appreciated that the wrapping material 10*k* may be provided in any manner described herein.

Figure 33:
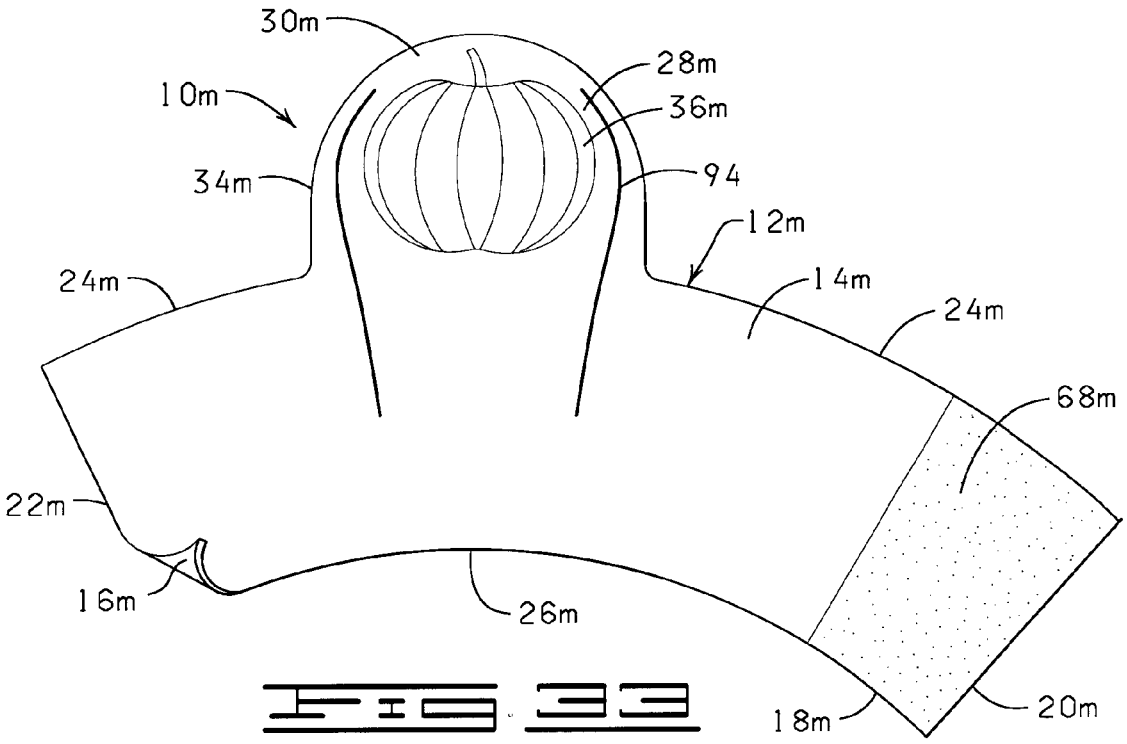
FIG. 33 is a perspective view of a modified wrapping material constructed exactly like the wrapping material of FIGS. 3, 7 and 20–21, but showing two arcuately curved sides of the sheet of material, and a bonding material disposed on a portion of the material, and showing reinforcing elements connected thereto.
Figure 34:
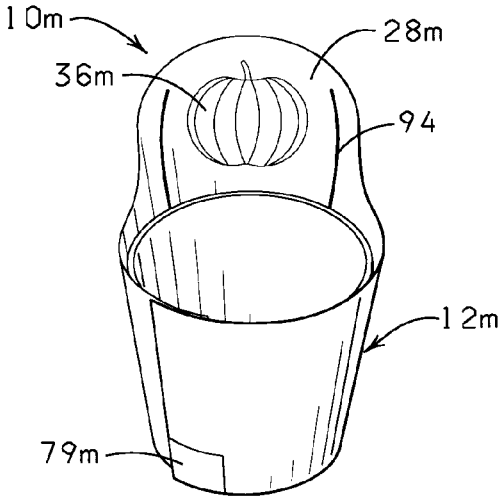
FIG. 34 is a perspective view of the wrapping material of FIG. 33, but showing a wrapped flower pot.

The Embodiment and Method of FIGS. 33–34

FIGS. 33–34 illustrate another embodiment and method of use of the present invention. The wrapping material 10*m* and the sheet of material 12*m* illustrated in the embodiment and used in this method are constructed exactly the same as the wrapping material 10*h* and the sheet of material 12*h* shown in FIGS. 7, 20 and 21 herein and described in detail previously, except that a plurality of shape sustaining elements 94 are connected to both the sheet of material 12*m* and the extension 28*m*. The method of use is identical to the one shown in FIGS. 20 and 21 and described in detail previously.

Figure 35:
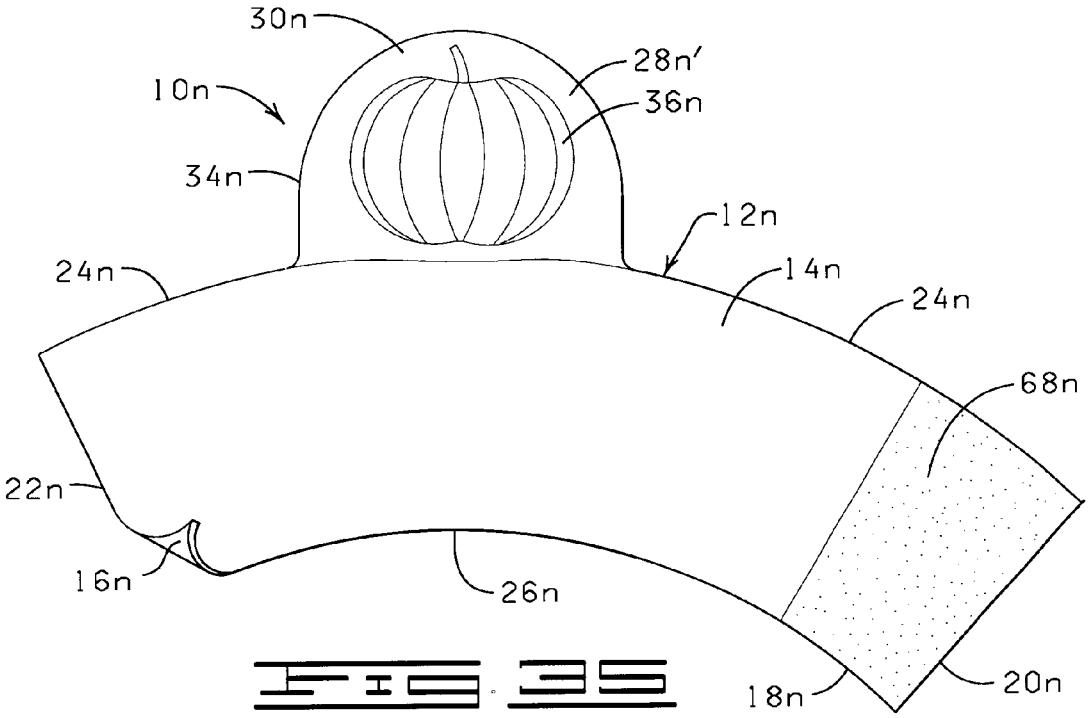
FIG. 35 is a perspective view of a modified wrapping material constructed exactly like the wrapping material of FIGS. 3, 7 and 20–21, but showing two arcuately curved sides of the sheet of material, and a bonding material disposed on a portion of the material, and showing a second extension aligned with and connected to the first extension.
Figure 36:
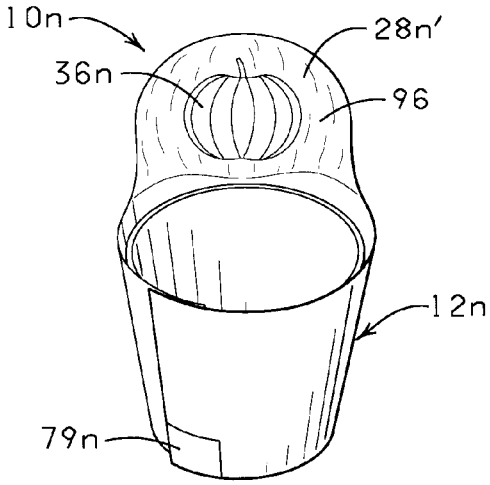
FIG. 36 is a perspective view of the wrapping material of FIG. 35, but showing a balloon portion in the wrapping material, and showing a wrapped flower pot.
Figure 37:
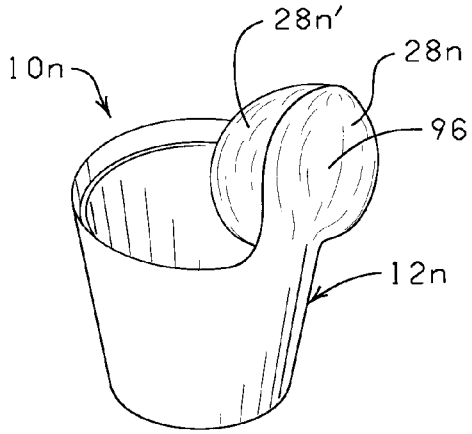
FIG. 37 is another perspective view of the wrapping material of FIGS. 35 and 36, showing a balloon portion in the wrapping material, and showing a wrapped flower pot.

The Embodiment and Method of FIGS. 35–37

FIGS. 35–37 illustrate another embodiment and method of use of the present invention. The wrapping material 10*n* and the sheet of material 12*n* illustrated in the embodiment and used in this method are constructed exactly the same as the wrapping material 10*h* and the sheet of material 12*h* shown in FIGS. 7, 20 and 21 herein and described in detail previously, except that a second extention 28*n*' has been provided, and a balloon portion 96 has been formed in the first and second extensions 28*n* and 28*n*', respectively. The method of use is identical to the one shown in FIGS. 20 and 21 and described in detail previously.

Change may be in the embodiment of the invention described herein, or in parts or elements of the embodiments described herein, or in the sequence of steps of the methods described herein without departing from the spirit and/or scope of the invention as defined in the following claims.

What is claimed is:

1. A decorative flower pot assembly, comprising:

a flower pot cover formed of a non-shaped sustaining sheet of material and having a closed lower end and an opened upper end with an object opening dimensioned to receive a flower pot extending through the opened upper end and an extension portion extending substantially in an upwardly direction above the remaining portion of the flower pot cover, the extension portion having a design indicia thereon, the flower pot cover having a plurality of overlapping folds formed between the upper end and the lower end, the sheet of material having an upper surface and a lower surface with at least one of the upper surface and the lower surface being a bondable surface such that the overlapping folds are fixed thereby enabling the flower pot cover to retain the predetermined shape; and a flower pot disposed in the object opening of the flower pot cover such that the design indicia on the extension portion is visible in conjunction with a floral grouping disposed in the flower pot.

2. The decorative flower pot assembly of claim 1 wherein the sheet of material is provided with a substantially square-shaped configuration having four corners such that the flower pot cover comprises four petal-like portions formed by the corners of the sheet of material, and wherein the extension portion of the sheet of material is positioned between adjacent petal-like portions.

3. The decorative flower pot assembly of claim 1 wherein the sheet of material is further defined as being a substantially flat, flexible sheet of material.

4. The decorative flower pot assembly of claim 1 wherein the sheet of material is constructed of a material selected from the group consisting of paper, metal foil, natural polymer films, synthetic polymer films, cling wrap, cloth, burlap and/or combinations thereof.

5. The decorative flower pot assembly of claim 2 wherein the sheet of material is further defined as being a substantially flat, flexible sheet of material.

6. The decorative flower pot assembly of claim 5 wherein the sheet of material is constructed of a material selected from the group consisting of paper, metal foil, natural polymer films, synthetic polymer films, cling wrap, cloth, burlap and/or combinations thereof.

* * * * *

UNITED STATES PATENT AND TRADEMARK OFFICE

CERTIFICATE OF CORRECTION

PATENT NO. : 6,474,018 B1
DATED : November 5, 2002
INVENTOR(S) : Donald E. Weder et al.

It is certified that error appears in the above-identified patent and that said Letters Patent is hereby corrected as shown below:

Title page, Item [54] and Column 1, lines 1-4,
Title, delete from the first occurrence of "WRAPPING" thru "METHODS" and substitute therefore new title -- DECORATIVE FLOWER POT ASSEMBLY --.

Title page,
Item [74], *Attorney, Agent, or Firm*, delete "Cokking" and substitute therefore -- Codding --.
Item [57], ABSTRACT,
Line 5, delete "warp" and substitute therefore -- wrap --.

Column 8,
Line 25, delete "is".

Column 11,
Line 14, after "38" add -- ' --.
Line 19, after "46" add -- ' --.

Column 12,
Line 52, after "a" and before "78g" add -- base --.
Line 53, after "cover" add -- 38' --.

Column 13,
Line 26, after "48g" and before "the" add -- of --.

Column 14,
Line 61, delete "50i" and substitute therefore -- 50j --.

Column 15,
Line 11, delete "50j" and substitute therefore -- 54 --.
Line 17, after "56j" and before "the" add -- of --.
Line 22, delete "34i" and substitute therefore -- 34j --.

UNITED STATES PATENT AND TRADEMARK OFFICE

CERTIFICATE OF CORRECTION

PATENT NO. : 6,474,018 B1
DATED : November 5, 2002
INVENTOR(S) : Donald E. Weder et al.

It is certified that error appears in the above-identified patent and that said Letters Patent is hereby corrected as shown below:

Column 16,
Line 9, delete “as”.
Line 23, after “74j” and before “a” add -- , --.
Line 24, delete “74” and substitute therefore -- 74j --.
Line 25, delete the first occurrence of “,”.
Line 67, after “previously” add -- described --.

Signed and Sealed this

Third Day of August, 2004

JON W. DUDAS
*Acting Director of the United States Patent and Trademark Office*